US005988638A

United States Patent [19]

Rodesch et al.

[11] Patent Number: 5,988,638

[45] Date of Patent: Nov. 23, 1999

[54] REEL TYPE SLOT MACHINE UTILIZING RANDOM NUMBER GENERATOR FOR SELECTING GAME RESULT

[75] Inventors: Dale F. Rodesch, San Diego; Gregory L. Rodesch, Oceanside, both of Calif.

[73] Assignee: Unislot, Inc., Calif.

[21] Appl. No.: 08/955,052

[22] Filed: Oct. 21, 1997

Related U.S. Application Data

[63] Continuation-in-part of application No. 08/876,046, Jun. 13, 1997, abandoned.

[51] Int. Cl.[6] ..... A63B 71/06; A63F 5/04; G07F 17/34

[52] U.S. Cl. ..... 273/143 R; 463/20

[58] Field of Search ..... 463/1, 16, 20, 463/25, 29–31, 36, 40–42; 273/143 R, 138.1, 138.2, 139; 364/410.1, 412.1

[56] References Cited

U.S. PATENT DOCUMENTS

| | | | |
|---|---|---|---|
| 3,439,281 | 4/1969 | McGuire et al. . | |
| 3,580,581 | 5/1971 | Raven | 273/138 A |
| 3,586,953 | 6/1971 | Markkanen | 318/635 |
| 3,606,337 | 9/1971 | Larsen et al. . | |
| 3,684,290 | 8/1972 | Wayne | 273/143 C |
| 3,770,269 | 11/1973 | Elder | 271/1 E |
| 3,834,712 | 9/1974 | Cox | 273/143 R |
| 3,838,258 | 9/1974 | Logan | 235/151.11 |
| 3,838,259 | 9/1974 | Kortenhaus | 235/152 |
| 3,913,922 | 10/1975 | Richards et al. | 273/143 R |
| 3,918,716 | 11/1975 | Nonaka et al. . | |
| 4,095,795 | 6/1978 | Saxton et al. | 273/143 R |
| 4,099,722 | 7/1978 | Rodesch et al. | 273/143 R |
| 4,138,114 | 2/1979 | Anderson | 273/143 R |
| 4,238,127 | 12/1980 | Lucero et al. | 273/143 R |
| 4,299,388 | 11/1981 | Resch et al. | 273/143 R |
| 4,421,310 | 12/1983 | Williams | 273/143 R |
| 4,448,419 | 5/1984 | Telnaes | 273/143 R |
| 4,573,681 | 3/1986 | Okada | 273/143 R |
| 4,618,150 | 10/1986 | Kimura | 273/143 R |

(List continued on next page.)

FOREIGN PATENT DOCUMENTS

| | | |
|---|---|---|
| 268377 | 6/1966 | Australia . |
| 962770 | 2/1975 | Canada . |
| 2 054 289 | 6/1971 | Germany . |
| 2 209 165 | 8/1973 | Germany . |
| 2 232 107 | 11/1973 | Germany . |
| 2 337 548 | 2/1974 | Germany . |

(List continued on next page.)

OTHER PUBLICATIONS

L.C. Meyer et al., "Random Generator Study", Jan. 1, 1974 pp. 3–1 through 3–3.

Waller M. Scott, "Electronic Casino", Mar. 1974 pp. 51–58.

*Primary Examiner*—Valencia Martin-Wallace
*Assistant Examiner*—Mark A. Sager
*Attorney, Agent, or Firm*—Lockwood, Alex, FitzGibbon & Cummings

[57] ABSTRACT

A reel-type slot machine includes a microprocessor driven game control circuit for randomly selecting a game result. Three reel assemblies each include a symbol-bearing display reel driven by a stepper motor for displaying game symbols corresponding to the game result. A random number generator within the game control circuit generates a random number within a predetermined range of random numbers for application to a look-up table wherein a game result consisting of three game symbols is identified. Each potential game result is associated with a subset of random numbers within the total range of random numbers. The size of the subset determines the probability of the game result occurring. An undesired game result may be avoided by providing no corresponding subset. After the game result symbols have been identified, the display reels are driven by the stepper motors to display the game symbols. Optional ramp-up and ramp-down circuits provide improved stepping accuracy.

50 Claims, 25 Drawing Sheets

U.S. PATENT DOCUMENTS

| | | | |
|---|---|---|---|
| 4,637,611 | 1/1987 | Hamada | 273/143 R |
| 4,660,833 | 4/1987 | Dickinson et al. | 273/143 R |
| 4,687,981 | 8/1987 | Okada | 318/696 |
| 4,693,477 | 9/1987 | Dickinson et al. | 273/143 R |
| 4,711,451 | 12/1987 | Pajak et al. | 273/143 R |
| 4,772,023 | 9/1988 | Okada | 273/143 R |
| 4,858,932 | 8/1989 | Keane | 173/143 R |
| 4,911,449 | 3/1990 | Dickinson et al. | 273/143 R |
| 4,912,389 | 3/1990 | Eguchi | 218/694 |
| 5,050,881 | 9/1991 | Nagao | 273/143 R |
| 5,058,893 | 10/1991 | Dickinson et al. | 273/143 R |
| 5,074,559 | 12/1991 | Okada | 273/143 R |
| 5,083,785 | 1/1992 | Okada | 273/143 R |
| 5,085,436 | 2/1992 | Bennett | 273/143 R |
| 5,102,134 | 4/1992 | Smyth | 173/138 A |
| 5,102,137 | 4/1992 | Ekiert | 273/143 R |
| 5,108,099 | 4/1992 | Smyth | 273/138 A |
| 5,154,421 | 10/1992 | Hamano | 273/143 R |
| 5,169,147 | 12/1992 | Hamano | 273/138 A |
| 5,205,555 | 4/1993 | Hamano | 273/143 R |
| 5,209,479 | 5/1993 | Nagao et al. | 273/143 R |
| 5,263,716 | 11/1993 | Smyth | 273/138 A |
| 5,380,008 | 1/1995 | Mathis et al. | 273/143 R |
| 5,423,541 | 6/1995 | Nicastro et al. | 273/143 R |
| 5,456,465 | 10/1995 | Durham | 273/138 A |
| 5,456,466 | 10/1995 | Miles | 273/143 R |
| 5,511,784 | 4/1996 | Furry et al. | 372/143 R |
| 5,524,888 | 6/1996 | Heidel | 463/22 |
| 5,564,701 | 10/1996 | Dettor | 463/16 |
| 5,569,084 | 10/1996 | Nicastro et al. | 463/20 |

FOREIGN PATENT DOCUMENTS

| | | |
|---|---|---|
| 1072381 | 6/1967 | United Kingdom . |
| 1107552 | 3/1968 | United Kingdom . |
| 1178302 | 1/1970 | United Kingdom . |
| 1252259 | 3/1971 | United Kingdom . |
| 1348309 | 3/1974 | United Kingdom . |
| 1368622 | 10/1974 | United Kingdom . |
| 1424713 | 2/1976 | United Kingdom . |
| 1430007 | 3/1976 | United Kingdom . |
| 1471866 | 4/1977 | United Kingdom . |
| 1545301 | 5/1979 | United Kingdom . |
| 1579731 | 11/1980 | United Kingdom . |
| 2065352 | 6/1981 | United Kingdom . |
| 1596363 | 8/1981 | United Kingdom . |

FIG. 1
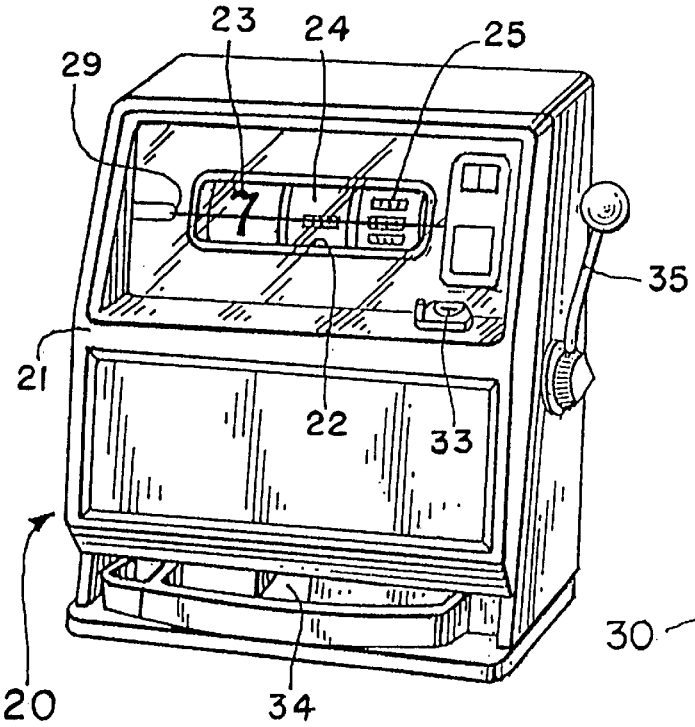
FIG. 3
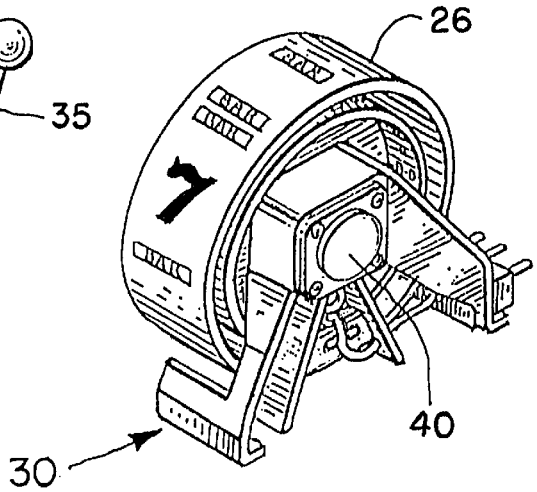
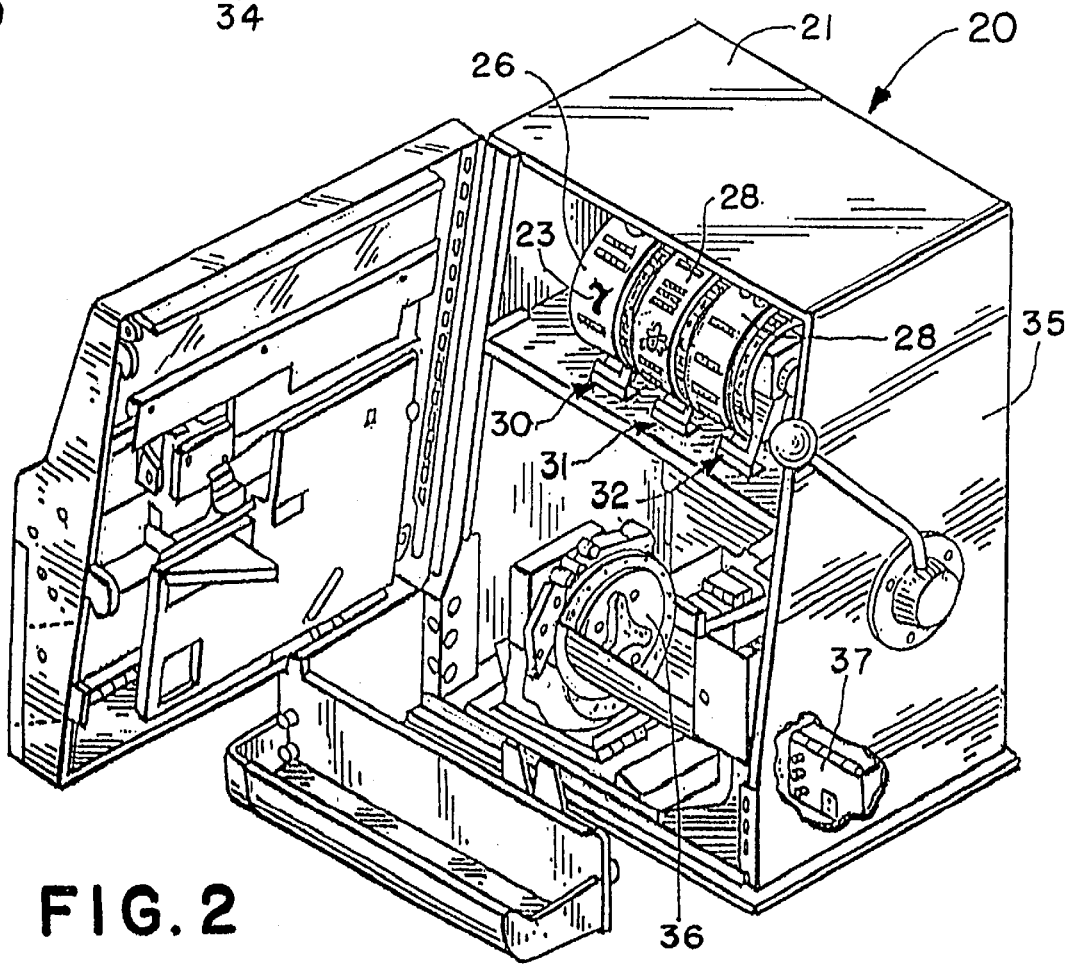
FIG. 2

| | Reel 1 | Reel 2 | Reel 3 | Subset | | Weight | Probability | Payout |
|---|---|---|---|---|---|---|---|---|
| | | | | From | To | | | |
| 1 | – | – | – | 0 | 2,416,821 | 2,416,822 | 0.009003364 | 0 |
| 2 | – | – | Ba | 2,416,822 | 4,833,643 | 2,416,822 | 0.009003364 | 0 |
| 3 | – | – | DB | 4,833,644 | 7,250,465 | 2,416,822 | 0.009003364 | 0 |
| 4 | – | – | 7 | 7,250,466 | 9,667,287 | 2,416,822 | 0.009003364 | 0 |
| 5 | – | – | TB | 9,667,288 | 12,084,109 | 2,416,822 | 0.009003364 | 0 |
| 6 | – | Ba | – | 12,084,110 | 14,500,931 | 2,416,822 | 0.009003364 | 0 |
| 7 | – | Ba | Ba | 14,500,932 | 16,917,753 | 2,416,822 | 0.009003364 | 0 |
| 8 | – | Ba | DB | 16,917,754 | 19,334,575 | 2,416,822 | 0.009003364 | 0 |
| 9 | – | Ba | 7 | 19,334,576 | 21,751,397 | 2,416,822 | 0.009003364 | 0 |
| 10 | – | Ba | TB | 21,751,398 | 24,168,219 | 2,416,822 | 0.009003364 | 0 |
| 11 | – | DB | – | 24,168,220 | 26,585,041 | 2,416,822 | 0.009003364 | 0 |
| 12 | – | DB | Ba | 26,585,042 | 29,001,863 | 2,416,822 | 0.009003364 | 0 |
| 13 | – | DB | DB | 29,001,864 | 31,418,685 | 2,416,822 | 0.009003364 | 0 |
| 14 | – | DB | 7 | 31,418,686 | 33,835,507 | 2,416,822 | 0.009003364 | 0 |
| 15 | – | DB | TB | 33,835,508 | 36,252,329 | 2,416,822 | 0.009003364 | 0 |
| 16 | – | 7 | – | 36,252,330 | 38,669,151 | 2,416,822 | 0.009003364 | 0 |
| 17 | – | 7 | Ba | 38,669,152 | 41,085,973 | 2,416,822 | 0.009003364 | 0 |
| 18 | – | 7 | DB | 41,085,974 | 43,502,795 | 2,416,822 | 0.009003364 | 0 |
| 19 | – | 7 | 7 | 43,502,796 | 45,919,617 | 2,416,822 | 0.009003364 | 0 |
| 20 | – | 7 | TB | 45,919,618 | 48,336,439 | 2,416,822 | 0.009003364 | 0 |
| 21 | – | TB | – | 48,336,440 | 50,753,261 | 2,416,822 | 0.009003364 | 0 |
| 22 | – | TB | Ba | 50,753,262 | 53,170,083 | 2,416,822 | 0.009003364 | 0 |
| 23 | – | TB | DB | 53,170,084 | 55,586,905 | 2,416,822 | 0.009003364 | 0 |
| 24 | – | TB | 7 | 55,586,906 | 58,003,727 | 2,416,822 | 0.009003364 | 0 |
| 25 | – | TB | TB | 58,003,728 | 60,420,549 | 2,416,822 | 0.009003364 | 0 |
| 26 | Ba | – | – | 60,420,550 | 62,837,371 | 2,416,822 | 0.009003364 | 0 |
| 27 | Ba | – | Ba | 62,837,372 | 65,254,193 | 2,416,822 | 0.009003364 | 0 |
| 28 | Ba | – | DB | 65,254,194 | 67,671,015 | 2,416,822 | 0.009003364 | 0 |
| 29 | Ba | – | 7 | 67,671,016 | 70,087,837 | 2,416,822 | 0.009003364 | 0 |
| 30 | Ba | – | TB | 70,087,838 | 72,504,659 | 2,416,822 | 0.009003364 | 0 |
| 31 | Ba | Ba | – | 72,504,660 | 74,921,481 | 2,416,822 | 0.009003364 | 0 |
| 32 | Ba | Ba | 7 | 74,921,482 | 77,338,303 | 2,416,822 | 0.009003364 | 0 |
| 33 | Ba | DB | – | 77,338,304 | 79,755,125 | 2,416,822 | 0.009003364 | 0 |
| 34 | Ba | DB | 7 | 79,755,126 | 82,171,947 | 2,416,822 | 0.009003364 | 0 |
| 35 | Ba | 7 | – | 82,171,948 | 84,588,769 | 2,416,822 | 0.009003364 | 0 |
| 36 | Ba | 7 | Ba | 84,588,770 | 87,005,591 | 2,416,822 | 0.009003364 | 0 |
| 37 | Ba | 7 | DB | 87,005,592 | 89,422,413 | 2,416,822 | 0.009003364 | 0 |
| 38 | Ba | 7 | 7 | 89,422,414 | 91,839,235 | 2,416,822 | 0.009003364 | 0 |
| 39 | Ba | 7 | TB | 91,839,236 | 94,256,057 | 2,416,822 | 0.009003364 | 0 |
| 40 | Ba | TB | – | 94,256,058 | 96,672,879 | 2,416,822 | 0.009003364 | 0 |
| 41 | Ba | TB | 7 | 96,672,880 | 99,089,701 | 2,416,822 | 0.009003364 | 0 |
| 42 | DB | – | – | 99,089,702 | 101,506,523 | 2,416,822 | 0.009003364 | 0 |
| 43 | DB | – | Ba | 101,506,524 | 103,923,345 | 2,416,822 | 0.009003364 | 0 |
| 44 | DB | – | DB | 103,923,346 | 106,340,167 | 2,416,822 | 0.009003364 | 0 |

FIG. 10A

| | Reel 1 | Reel 2 | Reel 3 | Subset | | Weight | Probability | Payout |
|---|---|---|---|---|---|---|---|---|
| | | | | From | To | | | |
| 45 | DB | -- | 7 | 106,340,168 | 108,756,989 | 2,416,822 | 0.009003364 | 0 |
| 46 | DB | -- | TB | 108,756,990 | 111,173,811 | 2,416,822 | 0.009003364 | 0 |
| 47 | DB | Ba | -- | 111,173,812 | 113,590,633 | 2,416,822 | 0.009003364 | 0 |
| 48 | DB | Ba | 7 | 113,590,634 | 116,007,455 | 2,416,822 | 0.009003364 | 0 |
| 49 | DB | DB | -- | 116,007,456 | 118,424,277 | 2,416,822 | 0.009003364 | 0 |
| 50 | DB | DB | 7 | 118,424,278 | 120,841,099 | 2,416,822 | 0.009003364 | 0 |
| 51 | DB | 7 | -- | 120,841,100 | 123,257,921 | 2,416,822 | 0.009003364 | 0 |
| 52 | DB | 7 | Ba | 123,257,922 | 125,674,743 | 2,416,822 | 0.009003364 | 0 |
| 53 | DB | 7 | DB | 125,674,744 | 128,091,565 | 2,416,822 | 0.009003364 | 0 |
| 54 | DB | 7 | 7 | 128,091,566 | 130,508,387 | 2,416,822 | 0.009003364 | 0 |
| 55 | DB | 7 | TB | 130,508,388 | 132,925,209 | 2,416,822 | 0.009003364 | 0 |
| 56 | DB | TB | -- | 132,925,210 | 135,342,031 | 2,416,822 | 0.009003364 | 0 |
| 57 | DB | TB | 7 | 135,342,032 | 137,758,853 | 2,416,822 | 0.009003364 | 0 |
| 58 | 7 | -- | -- | 137,758,854 | 140,175,675 | 2,416,822 | 0.009003364 | 0 |
| 59 | 7 | -- | Ba | 140,175,676 | 142,592,497 | 2,416,822 | 0.009003364 | 0 |
| 60 | 7 | -- | DB | 142,592,498 | 145,009,319 | 2,416,822 | 0.009003364 | 0 |
| 61 | 7 | -- | 7 | 145,009,320 | 147,426,141 | 2,416,822 | 0.009003364 | 0 |
| 62 | 7 | -- | TB | 147,426,142 | 149,842,963 | 2,416,822 | 0.009003364 | 0 |
| 63 | 7 | Ba | -- | 149,842,964 | 152,259,785 | 2,416,822 | 0.009003364 | 0 |
| 64 | 7 | Ba | Ba | 152,259,786 | 154,676,607 | 2,416,822 | 0.009003364 | 0 |
| 65 | 7 | Ba | DB | 154,676,608 | 157,093,429 | 2,416,822 | 0.009003364 | 0 |
| 66 | 7 | Ba | 7 | 157,093,430 | 159,510,251 | 2,416,822 | 0.009003364 | 0 |
| 67 | 7 | Ba | TB | 159,510,252 | 161,927,073 | 2,416,822 | 0.009003364 | 0 |
| 68 | 7 | DB | -- | 161,927,074 | 164,343,895 | 2,416,822 | 0.009003364 | 0 |
| 69 | 7 | DB | Ba | 164,343,896 | 166,760,717 | 2,416,822 | 0.009003364 | 0 |
| 70 | 7 | DB | DB | 166,760,718 | 169,177,539 | 2,416,822 | 0.009003364 | 0 |
| 71 | 7 | DB | 7 | 169,177,540 | 171,594,361 | 2,416,822 | 0.009003364 | 0 |
| 72 | 7 | DB | TB | 171,594,362 | 174,011,183 | 2,416,822 | 0.009003364 | 0 |
| 73 | 7 | 7 | -- | 174,011,184 | 176,428,005 | 2,416,822 | 0.009003364 | 0 |
| 74 | 7 | 7 | Ba | 176,428,006 | 178,844,827 | 2,416,822 | 0.009003364 | 0 |
| 75 | 7 | 7 | DB | 178,844,828 | 181,261,649 | 2,416,822 | 0.009003364 | 0 |
| 76 | 7 | 7 | TB | 181,261,650 | 183,678,471 | 2,416,822 | 0.009003364 | 0 |
| 77 | 7 | TB | -- | 183,678,472 | 186,095,293 | 2,416,822 | 0.009003364 | 0 |
| 78 | 7 | TB | Ba | 186,095,294 | 188,512,115 | 2,416,822 | 0.009003364 | 0 |
| 79 | 7 | TB | DB | 188,512,116 | 190,928,937 | 2,416,822 | 0.009003364 | 0 |
| 80 | 7 | TB | 7 | 190,928,938 | 193,345,759 | 2,416,822 | 0.009003364 | 0 |
| 81 | 7 | TB | TB | 193,345,760 | 195,762,581 | 2,416,822 | 0.009003364 | 0 |
| 82 | TB | -- | -- | 195,762,582 | 198,179,403 | 2,416,822 | 0.009003364 | 0 |
| 83 | TB | -- | Ba | 198,179,404 | 200,596,225 | 2,416,822 | 0.009003364 | 0 |
| 84 | TB | -- | DB | 200,596,226 | 203,013,047 | 2,416,822 | 0.009003364 | 0 |
| 85 | TB | -- | 7 | 203,013,048 | 205,429,869 | 2,416,822 | 0.009003364 | 0 |
| 86 | TB | -- | TB | 205,429,870 | 207,846,691 | 2,416,822 | 0.009003364 | 0 |
| 87 | TB | Ba | -- | 207,846,692 | 210,263,513 | 2,416,822 | 0.009003364 | 0 |
| 88 | TB | Ba | 7 | 210,263,514 | 212,680,335 | 2,416,822 | 0.009003364 | 0 |

FIG. 10B

| | Reel 1 | Reel 2 | Reel 3 | Subset | | Weight | Probability | Payout |
|---|---|---|---|---|---|---|---|---|
| | | | | From | To | | | |
| 89 | TB | DB | – | 212,680,336 | 215,097,157 | 2,416,822 | 0.009003364 | 0 |
| 90 | TB | DB | 7 | 215,097,158 | 217,513,979 | 2,416,822 | 0.009003364 | 0 |
| 91 | TB | 7 | – | 217,513,980 | 219,930,801 | 2,416,822 | 0.009003364 | 0 |
| 92 | TB | 7 | Ba | 219,930,802 | 222,347,623 | 2,416,822 | 0.009003364 | 0 |
| 93 | TB | 7 | DB | 222,347,624 | 224,764,445 | 2,416,822 | 0.009003364 | 0 |
| 94 | TB | 7 | 7 | 224,764,446 | 227,181,267 | 2,416,822 | 0.009003364 | 0 |
| 95 | TB | 7 | TB | 227,181,268 | 229,598,089 | 2,416,822 | 0.009003364 | 0 |
| 96 | TB | TB | – | 229,598,090 | 232,014,911 | 2,416,822 | 0.009003364 | 0 |
| 97 | TB | TB | 7 | 232,014,912 | 234,431,733 | 2,416,822 | 0.009003364 | 0 |
| 98 | – | – | Ch | 234,431,734 | 234,685,255 | 253,522 | 0.000944443 | 3 |
| 99 | – | Ba | Ch | 234,685,256 | 234,938,777 | 253,522 | 0.000944443 | 3 |
| 100 | – | Ch | – | 234,938,778 | 235,192,299 | 253,522 | 0.000944443 | 3 |
| 101 | – | Ch | Ba | 235,192,300 | 235,445,821 | 253,522 | 0.000944443 | 3 |
| 102 | – | Ch | Ch | 235,445,822 | 236,079,627 | 633,806 | 0.002361111 | 6 |
| 103 | – | Ch | DB | 236,079,628 | 236,333,149 | 253,522 | 0.000944443 | 3 |
| 104 | – | Ch | 7 | 236,333,150 | 236,586,671 | 253,522 | 0.000944443 | 3 |
| 105 | – | Ch | TB | 236,586,672 | 236,840,193 | 253,522 | 0.000944443 | 3 |
| 106 | – | DB | Ch | 236,840,194 | 237,093,715 | 253,522 | 0.000944443 | 3 |
| 107 | – | 7 | Ch | 237,093,716 | 237,347,237 | 253,522 | 0.000944443 | 3 |
| 108 | – | TB | Ch | 237,347,238 | 237,600,759 | 253,522 | 0.000944443 | 3 |
| 109 | Ba | – | Ch | 237,600,760 | 237,854,281 | 253,522 | 0.000944443 | 3 |
| 110 | Ba | Ba | Ba | 237,854,282 | 238,804,990 | 950,709 | 0.003541667 | 20 |
| 111 | Ba | Ba | Ch | 238,804,991 | 239,058,512 | 253,522 | 0.000944443 | 3 |
| 112 | Ba | Ba | DB | 239,058,513 | 239,157,544 | 99,032 | 0.000368923 | 8 |
| 113 | Ba | Ba | TB | 239,157,545 | 239,256,576 | 99,032 | 0.000368923 | 8 |
| 114 | Ba | Ch | – | 239,256,577 | 239,510,098 | 253,522 | 0.000944443 | 3 |
| 115 | Ba | Ch | Ba | 239,510,099 | 239,763,620 | 253,522 | 0.000944443 | 3 |
| 116 | Ba | Ch | Ch | 239,763,621 | 240,397,426 | 633,806 | 0.002361111 | 6 |
| 117 | Ba | Ch | DB | 240,397,427 | 240,650,948 | 253,522 | 0.000944443 | 3 |
| 118 | Ba | Ch | 7 | 240,650,949 | 240,904,470 | 253,522 | 0.000944443 | 3 |
| 119 | Ba | Ch | TB | 240,904,471 | 241,157,992 | 253,522 | 0.000944443 | 3 |
| 120 | Ba | DB | Ba | 241,157,993 | 241,257,024 | 99,032 | 0.000368923 | 8 |
| 121 | Ba | DB | Ch | 241,257,025 | 241,510,546 | 253,522 | 0.000944443 | 3 |
| 122 | Ba | DB | DB | 241,510,547 | 241,609,578 | 99,032 | 0.000368923 | 8 |
| 123 | Ba | DB | TB | 241,609,579 | 241,708,610 | 99,032 | 0.000368923 | 8 |
| 124 | Ba | 7 | Ch | 241,708,611 | 241,962,132 | 253,522 | 0.000944443 | 3 |
| 125 | Ba | TB | Ba | 241,962,133 | 242,061,164 | 99,032 | 0.000368923 | 8 |
| 126 | Ba | TB | Ch | 242,061,165 | 242,314,686 | 253,522 | 0.000944443 | 3 |
| 127 | Ba | TB | DB | 242,314,687 | 242,413,718 | 99,032 | 0.000368923 | 8 |
| 128 | Ba | TB | TB | 242,413,719 | 242,512,750 | 99,032 | 0.000368923 | 8 |
| 129 | Ch | – | – | 242,512,751 | 242,766,272 | 253,522 | 0.000944443 | 3 |
| 130 | Ch | – | Ba | 242,766,273 | 243,019,794 | 253,522 | 0.000944443 | 3 |
| 131 | Ch | – | Ch | 243,019,795 | 243,653,600 | 633,806 | 0.002361111 | 6 |
| 132 | Ch | – | DB | 243,653,601 | 243,907,122 | 253,522 | 0.000944443 | 3 |

FIG.10c

| | Reel 1 | Reel 2 | Reel 3 | Subset | | Weight | Probability | Payout |
|---|---|---|---|---|---|---|---|---|
| | | | | From | To | | | |
| 133 | Ch | – | 7 | 243,907,123 | 244,160,644 | 253,522 | 0.000944443 | 3 |
| 134 | Ch | – | TB | 244,160,645 | 244,414,166 | 253,522 | 0.000944443 | 3 |
| 135 | Ch | Ba | – | 244,414,167 | 244,667,688 | 253,522 | 0.000944443 | 3 |
| 136 | Ch | Ba | Ba | 244,667,689 | 244,921,210 | 253,522 | 0.000944443 | 3 |
| 137 | Ch | Ba | Ch | 244,921,211 | 245,555,016 | 633,806 | 0.002361111 | 6 |
| 138 | Ch | Ba | DB | 245,555,017 | 245,808,538 | 253,522 | 0.000944443 | 3 |
| 139 | Ch | Ba | 7 | 245,808,539 | 246,062,060 | 253,522 | 0.000944443 | 3 |
| 140 | Ch | Ba | TB | 246,062,061 | 246,315,582 | 253,522 | 0.000944443 | 3 |
| 141 | Ch | Ch | – | 246,315,583 | 246,949,388 | 633,806 | 0.002361111 | 6 |
| 142 | Ch | Ch | Ba | 246,949,389 | 247,583,194 | 633,806 | 0.002361111 | 6 |
| 143 | Ch | Ch | Ch | 247,583,195 | 249,167,709 | 1,584,515 | 0.005902778 | 12 |
| 144 | Ch | Ch | DB | 249,167,710 | 249,801,515 | 633,806 | 0.002361111 | 6 |
| 145 | Ch | Ch | 7 | 249,801,516 | 250,435,321 | 633,806 | 0.002361111 | 6 |
| 146 | Ch | Ch | TB | 250,435,322 | 251,069,127 | 633,806 | 0.002361111 | 6 |
| 147 | Ch | DB | – | 251,069,128 | 251,322,649 | 253,522 | 0.000944443 | 3 |
| 148 | Ch | DB | Ba | 251,322,650 | 251,576,171 | 253,522 | 0.000944443 | 3 |
| 149 | Ch | DB | Ch | 251,576,172 | 252,209,977 | 633,806 | 0.002361111 | 6 |
| 150 | Ch | DB | DB | 252,209,978 | 252,463,499 | 253,522 | 0.000944443 | 3 |
| 151 | Ch | DB | 7 | 252,463,500 | 252,717,021 | 253,522 | 0.000944443 | 3 |
| 152 | Ch | DB | TB | 252,717,022 | 252,970,543 | 253,522 | 0.000944443 | 3 |
| 153 | Ch | 7 | – | 252,970,544 | 253,224,065 | 253,522 | 0.000944443 | 3 |
| 154 | Ch | 7 | Ba | 253,224,066 | 253,477,587 | 253,522 | 0.000944443 | 3 |
| 155 | Ch | 7 | Ch | 253,477,588 | 254,111,393 | 633,806 | 0.002361111 | 6 |
| 156 | Ch | 7 | DB | 254,111,394 | 254,364,915 | 253,522 | 0.000944443 | 3 |
| 157 | Ch | 7 | 7 | 254,364,916 | 254,618,437 | 253,522 | 0.000944443 | 3 |
| 158 | Ch | 7 | TB | 254,618,438 | 254,871,959 | 253,522 | 0.000944443 | 3 |
| 159 | Ch | TB | – | 254,871,960 | 255,125,481 | 253,522 | 0.000944443 | 3 |
| 160 | Ch | TB | Ba | 255,125,482 | 255,379,003 | 253,522 | 0.000944443 | 3 |
| 161 | Ch | TB | Ch | 255,379,004 | 256,012,809 | 633,806 | 0.002361111 | 6 |
| 162 | Ch | TB | DB | 256,012,810 | 256,266,331 | 253,522 | 0.000944443 | 3 |
| 163 | Ch | TB | 7 | 256,266,332 | 256,519,853 | 253,522 | 0.000944443 | 3 |
| 164 | Ch | TB | TB | 256,519,854 | 256,773,375 | 253,522 | 0.000944443 | 3 |
| 165 | DB | – | Ch | 256,773,376 | 257,026,897 | 253,522 | 0.000944443 | 3 |
| 166 | DB | Ba | Ba | 257,026,898 | 257,125,929 | 99,032 | 0.000368923 | 8 |
| 167 | DB | Ba | Ch | 257,125,930 | 257,379,451 | 253,522 | 0.000944443 | 3 |
| 168 | DB | Ba | DB | 257,379,452 | 257,478,483 | 99,032 | 0.000368923 | 8 |
| 169 | DB | Ba | TB | 257,478,484 | 257,577,515 | 99,032 | 0.000368923 | 8 |
| 170 | DB | Ch | – | 257,577,516 | 257,831,037 | 253,522 | 0.000944443 | 3 |
| 171 | DB | Ch | Ba | 257,831,038 | 258,084,559 | 253,522 | 0.000944443 | 3 |
| 172 | DB | Ch | Ch | 258,084,560 | 258,718,365 | 633,806 | 0.002361111 | 6 |
| 173 | DB | Ch | DB | 258,718,366 | 258,971,887 | 253,522 | 0.000944443 | 3 |
| 174 | DB | Ch | 7 | 258,971,888 | 259,225,409 | 253,522 | 0.000944443 | 3 |
| 175 | DB | Ch | TB | 259,225,410 | 259,478,931 | 253,522 | 0.000944443 | 3 |
| 176 | DB | DB | Ba | 259,478,932 | 259,577,963 | 99,032 | 0.000368923 | 8 |

FIG. 10D

| | Reel 1 | Reel 2 | Reel 3 | Subset | | Weight | Probability | Payout |
|---|---|---|---|---|---|---|---|---|
| | | | | From | To | | | |
| 177 | DB | DB | Ch | 259,577,964 | 259,831,485 | 253,522 | 0.000944443 | 3 |
| 178 | DB | DB | DB | 259,831,486 | 260,211,769 | 380,284 | 0.001416668 | 50 |
| 179 | DB | DB | TB | 260,211,770 | 260,310,801 | 99,032 | 0.000368923 | 8 |
| 180 | DB | 7 | Ch | 260,310,802 | 260,564,323 | 253,522 | 0.000944443 | 3 |
| 181 | DB | TB | Ba | 260,564,324 | 260,663,355 | 99,032 | 0.000368923 | 8 |
| 182 | DB | TB | Ch | 260,663,356 | 260,916,877 | 253,522 | 0.000944443 | 3 |
| 183 | DB | TB | DB | 260,916,878 | 261,015,909 | 99,032 | 0.000368923 | 8 |
| 184 | DB | TB | TB | 261,015,910 | 261,114,941 | 99,032 | 0.000368923 | 8 |
| 185 | 7 | – | Ch | 261,114,942 | 261,368,463 | 253,522 | 0.000944443 | 3 |
| 186 | 7 | Ba | Ch | 261,368,464 | 261,621,985 | 253,522 | 0.000944443 | 3 |
| 187 | 7 | Ch | – | 261,621,986 | 261,875,507 | 253,522 | 0.000944443 | 3 |
| 188 | 7 | Ch | Ba | 261,875,508 | 262,129,029 | 253,522 | 0.000944443 | 3 |
| 189 | 7 | Ch | Ch | 262,129,030 | 262,762,835 | 633,806 | 0.002361111 | 6 |
| 190 | 7 | Ch | DB | 262,762,836 | 263,016,357 | 253,522 | 0.000944443 | 3 |
| 191 | 7 | Ch | 7 | 263,016,358 | 263,269,879 | 253,522 | 0.000944443 | 3 |
| 192 | 7 | Ch | TB | 263,269,880 | 263,523,401 | 253,522 | 0.000944443 | 3 |
| 193 | 7 | DB | Ch | 263,523,402 | 263,776,923 | 253,522 | 0.000944443 | 3 |
| 194 | 7 | 7 | Ch | 263,776,924 | 264,030,445 | 253,522 | 0.000944443 | 3 |
| 195 | 7 | 7 | 7 | 264,030,446 | 264,030,464 | 19 | 0.000000071 | 1000000 |
| 196 | 7 | TB | Ch | 264,030,465 | 264,283,986 | 253,522 | 0.000944443 | 3 |
| 197 | TB | – | Ch | 264,283,987 | 264,537,508 | 253,522 | 0.000944443 | 3 |
| 198 | TB | Ba | Ba | 264,537,509 | 264,636,540 | 99,032 | 0.000368923 | 8 |
| 199 | TB | Ba | Ch | 264,636,541 | 264,890,062 | 253,522 | 0.000944443 | 3 |
| 200 | TB | Ba | DB | 264,890,063 | 264,989,094 | 99,032 | 0.000368923 | 8 |
| 201 | TB | Ba | TB | 264,989,095 | 265,088,126 | 99,032 | 0.000368923 | 8 |
| 202 | TB | Ch | – | 265,088,127 | 265,341,648 | 253,522 | 0.000944443 | 3 |
| 203 | TB | Ch | Ba | 265,341,649 | 265,595,170 | 253,522 | 0.000944443 | 3 |
| 204 | TB | Ch | Ch | 265,595,171 | 266,228,976 | 633,806 | 0.002361111 | 6 |
| 205 | TB | Ch | DB | 266,228,977 | 266,482,498 | 253,522 | 0.000944443 | 3 |
| 206 | TB | Ch | 7 | 266,482,499 | 266,736,020 | 253,522 | 0.000944443 | 3 |
| 207 | TB | Ch | TB | 266,736,021 | 266,989,542 | 253,522 | 0.000944443 | 3 |
| 208 | TB | DB | Ba | 266,989,543 | 267,088,574 | 99,032 | 0.000368923 | 8 |
| 209 | TB | DB | Ch | 267,088,575 | 267,342,096 | 253,522 | 0.000944443 | 3 |
| 210 | TB | DB | DB | 267,342,097 | 267,441,128 | 99,032 | 0.000368923 | 8 |
| 211 | TB | DB | TB | 267,441,129 | 267,540,160 | 99,032 | 0.000368923 | 8 |
| 212 | TB | 7 | Ch | 267,540,161 | 267,793,682 | 253,522 | 0.000944443 | 3 |
| 213 | TB | TB | Ba | 267,793,683 | 267,892,714 | 99,032 | 0.000368923 | 8 |
| 214 | TB | TB | Ch | 267,892,715 | 268,146,281 | 253,567 | 0.000944611 | 3 |
| 215 | TB | TB | DB | 268,146,282 | 268,245,313 | 99,032 | 0.000368923 | 8 |
| 216 | TB | TB | TB | 268,245,314 | 268,435,455 | 190,142 | 0.000708334 | 100 |
| | | | | | | | | |
| | | | | | | 268,435,456 | 1.000000000 | |

FIG. 10E

| RANDOM NUMBER | RANDOM NUMBER A27 | A26 | A25 | A2 | A1 | A0 | PAYOUT D28 | D27 | D26 | D11 | D10 | D9 | SYMBOL 3 D8 | D7 | D6 | SYMBOL 2 D5 | D4 | D3 | SYMBOL 1 D2 | D1 | D0 |
|---|---|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 1 | 0 | 0 | 1 | 0 | 0 | 1 |
| 1 | 0 | 0 | 0 | 0 | 0 | 1 | 0 | 0 | 0 | 0 | 0 | 0 | 0 | 0 | 1 | 0 | 0 | 1 | 0 | 0 | 1 |
| 2 | 0 | 0 | 0 | 0 | 1 | 0 | 0 | 0 | 0 | 0 | 0 | 0 | 0 | 0 | 1 | 0 | 0 | 1 | 0 | 0 | 1 |
| ~ | ~ | ~ | ~ | ~ | ~ | ~ | ~ | ~ | ~ | ~ | ~ | ~ | ~ | ~ | ~ | ~ | ~ | ~ | ~ | ~ | ~ |
| 239,014,025 | 1 | 1 | ~ | 0 | 0 | 1 | 0 | 0 | 0 | ~ | 1 | 1 | 0 | 1 | 1 | 0 | 1 | 1 | 0 | 1 | 1 |
| ~ | ~ | ~ | ~ | ~ | ~ | ~ | ~ | ~ | ~ | ~ | ~ | ~ | ~ | ~ | ~ | ~ | ~ | ~ | ~ | ~ | ~ |
| 260,435,453 | 1 | 1 | 1 | 1 | 0 | 1 | 0 | 0 | 0 | 1 | 0 | 0 | 1 | 0 | 1 | 1 | 0 | 1 | 1 | 0 | 1 |
| 268,435,454 | 1 | 1 | 1 | 1 | 1 | 0 | 0 | 0 | 0 | 1 | 0 | 0 | 1 | 0 | 1 | 1 | 0 | 1 | 1 | 0 | 1 |
| 268,435,455 | 1 | 1 | 1 | 1 | 1 | 1 | 0 | 0 | 0 | 1 | 0 | 0 | 1 | 0 | 1 | 1 | 0 | 1 | 1 | 0 | 1 |

| | Reel 1 | Reel 2 | Reel 3 | Subset From | Subset To | Weight | Probability | Payout |
|---|---|---|---|---|---|---|---|---|
| 1 | – | – | – | | | 0 | 0.000000000 | 0 |
| 2 | – | – | Ba | 0 | 2,441,997 | 2,441,998 | 0.009097151 | 0 |
| 3 | – | – | DB | 2,441,998 | 4,883,995 | 2,441,998 | 0.009097151 | 0 |
| 4 | – | – | 7 | 4,883,996 | 7,325,993 | 2,441,998 | 0.009097151 | 0 |
| 5 | – | – | TB | 7,325,994 | 9,767,991 | 2,441,998 | 0.009097151 | 0 |
| 6 | – | Ba | – | 9,767,992 | 12,209,989 | 2,441,998 | 0.009097151 | 0 |
| 7 | – | Ba | Ba | 12,209,990 | 14,651,987 | 2,441,998 | 0.009097151 | 0 |
| 8 | – | Ba | DB | 14,651,988 | 17,093,985 | 2,441,998 | 0.009097151 | 0 |
| 9 | – | Ba | 7 | 17,093,986 | 19,535,983 | 2,441,998 | 0.009097151 | 0 |
| 10 | – | Ba | TB | 19,535,984 | 21,977,981 | 2,441,998 | 0.009097151 | 0 |
| 11 | – | DB | – | 21,977,982 | 24,419,979 | 2,441,998 | 0.009097151 | 0 |
| 12 | – | DB | Ba | 24,419,980 | 26,861,977 | 2,441,998 | 0.009097151 | 0 |
| 13 | – | DB | DB | 26,861,978 | 29,303,975 | 2,441,998 | 0.009097151 | 0 |
| 14 | – | DB | 7 | 29,303,976 | 31,745,973 | 2,441,998 | 0.009097151 | 0 |
| 15 | – | DB | TB | 31,745,974 | 34,187,971 | 2,441,998 | 0.009097151 | 0 |
| 16 | – | 7 | – | 34,187,972 | 36,629,969 | 2,441,998 | 0.009097151 | 0 |
| 17 | – | 7 | Ba | 36,629,970 | 39,071,967 | 2,441,998 | 0.009097151 | 0 |
| 18 | – | 7 | DB | 39,071,968 | 41,513,965 | 2,441,998 | 0.009097151 | 0 |
| 19 | – | 7 | 7 | 41,513,966 | 43,955,963 | 2,441,998 | 0.009097151 | 0 |
| 20 | – | 7 | TB | 43,955,964 | 46,397,961 | 2,441,998 | 0.009097151 | 0 |
| 21 | – | TB | – | 46,397,962 | 48,839,959 | 2,441,998 | 0.009097151 | 0 |
| 22 | – | TB | Ba | 48,839,960 | 51,281,957 | 2,441,998 | 0.009097151 | 0 |
| 23 | – | TB | DB | 51,281,958 | 53,723,955 | 2,441,998 | 0.009097151 | 0 |
| 24 | – | TB | 7 | 53,723,956 | 56,165,953 | 2,441,998 | 0.009097151 | 0 |
| 25 | – | TB | TB | 56,165,954 | 58,607,951 | 2,441,998 | 0.009097151 | 0 |
| 26 | Ba | – | – | 58,607,952 | 61,049,949 | 2,441,998 | 0.009097151 | 0 |
| 27 | Ba | – | Ba | 61,049,950 | 63,491,947 | 2,441,998 | 0.009097151 | 0 |
| 28 | Ba | – | DB | 63,491,948 | 65,933,945 | 2,441,998 | 0.009097151 | 0 |
| 29 | Ba | – | 7 | 65,933,946 | 68,375,943 | 2,441,998 | 0.009097151 | 0 |
| 30 | Ba | – | TB | 68,375,944 | 70,817,941 | 2,441,998 | 0.009097151 | 0 |
| 31 | Ba | Ba | – | 70,817,942 | 73,259,939 | 2,441,998 | 0.009097151 | 0 |
| 32 | Ba | Ba | 7 | 73,259,940 | 75,701,937 | 2,441,998 | 0.009097151 | 0 |
| 33 | Ba | DB | – | 75,701,938 | 78,143,935 | 2,441,998 | 0.009097151 | 0 |
| 34 | Ba | DB | 7 | 78,143,936 | 80,585,933 | 2,441,998 | 0.009097151 | 0 |
| 35 | Ba | 7 | – | 80,585,934 | 83,027,931 | 2,441,998 | 0.009097151 | 0 |
| 36 | Ba | 7 | Ba | 83,027,932 | 85,469,929 | 2,441,998 | 0.009097151 | 0 |
| 37 | Ba | 7 | DB | 85,469,930 | 87,911,927 | 2,441,998 | 0.009097151 | 0 |
| 38 | Ba | 7 | 7 | 87,911,928 | 90,353,925 | 2,441,998 | 0.009097151 | 0 |
| 39 | Ba | 7 | TB | 90,353,926 | 92,795,923 | 2,441,998 | 0.009097151 | 0 |
| 40 | Ba | TB | – | 92,795,924 | 95,237,921 | 2,441,998 | 0.009097151 | 0 |
| 41 | Ba | TB | 7 | 95,237,922 | 97,679,919 | 2,441,998 | 0.009097151 | 0 |
| 42 | DB | – | – | 97,679,920 | 100,121,917 | 2,441,998 | 0.009097151 | 0 |
| 43 | DB | – | Ba | 100,121,918 | 102,563,915 | 2,441,998 | 0.009097151 | 0 |
| 44 | DB | – | DB | 102,563,916 | 105,005,913 | 2,441,998 | 0.009097151 | 0 |

FIG. 23A

| | Reel 1 | Reel 2 | Reel 3 | Subset From | Subset To | Weight | Probability | Payout |
|---|---|---|---|---|---|---|---|---|
| 45 | DB | – | 7 | 105,005,914 | 107,447,911 | 2,441,998 | 0.009097151 | 0 |
| 46 | DB | – | TB | 107,447,912 | 109,889,909 | 2,441,998 | 0.009097151 | 0 |
| 47 | DB | Ba | – | 109,889,910 | 112,331,907 | 2,441,998 | 0.009097151 | 0 |
| 48 | DB | Ba | 7 | 112,331,908 | 114,773,905 | 2,441,998 | 0.009097151 | 0 |
| 49 | DB | DB | – | 114,773,906 | 117,215,903 | 2,441,998 | 0.009097151 | 0 |
| 50 | DB | DB | 7 | 117,215,904 | 119,657,901 | 2,441,998 | 0.009097151 | 0 |
| 51 | DB | 7 | – | 119,657,902 | 122,099,899 | 2,441,998 | 0.009097151 | 0 |
| 52 | DB | 7 | Ba | 122,099,900 | 124,541,897 | 2,441,998 | 0.009097151 | 0 |
| 53 | DB | 7 | DB | 124,541,898 | 126,983,895 | 2,441,998 | 0.009097151 | 0 |
| 54 | DB | 7 | 7 | 126,983,896 | 129,425,893 | 2,441,998 | 0.009097151 | 0 |
| 55 | DB | 7 | TB | 129,425,894 | 131,867,891 | 2,441,998 | 0.009097151 | 0 |
| 56 | DB | TB | – | 131,867,892 | 134,309,889 | 2,441,998 | 0.009097151 | 0 |
| 57 | DB | TB | 7 | 134,309,890 | 136,751,887 | 2,441,998 | 0.009097151 | 0 |
| 58 | 7 | – | – | 136,751,888 | 139,193,885 | 2,441,998 | 0.009097151 | 0 |
| 59 | 7 | – | Ba | 139,193,886 | 141,635,883 | 2,441,998 | 0.009097151 | 0 |
| 60 | 7 | – | DB | 141,635,884 | 144,077,881 | 2,441,998 | 0.009097151 | 0 |
| 61 | 7 | – | 7 | 144,077,882 | 146,519,879 | 2,441,998 | 0.009097151 | 0 |
| 62 | 7 | – | TB | 146,519,880 | 148,961,877 | 2,441,998 | 0.009097151 | 0 |
| 63 | 7 | Ba | – | 148,961,878 | 151,403,875 | 2,441,998 | 0.009097151 | 0 |
| 64 | 7 | Ba | Ba | 151,403,876 | 153,845,873 | 2,441,998 | 0.009097151 | 0 |
| 65 | 7 | Ba | DB | 153,845,874 | 156,287,871 | 2,441,998 | 0.009097151 | 0 |
| 66 | 7 | Ba | 7 | 156,287,872 | 158,729,869 | 2,441,998 | 0.009097151 | 0 |
| 67 | 7 | Ba | TB | 158,729,870 | 161,171,867 | 2,441,998 | 0.009097151 | 0 |
| 68 | 7 | DB | – | 161,171,868 | 163,613,865 | 2,441,998 | 0.009097151 | 0 |
| 69 | 7 | DB | Ba | 163,613,866 | 166,055,863 | 2,441,998 | 0.009097151 | 0 |
| 70 | 7 | DB | DB | 166,055,864 | 168,497,861 | 2,441,998 | 0.009097151 | 0 |
| 71 | 7 | DB | 7 | 168,497,862 | 170,939,859 | 2,441,998 | 0.009097151 | 0 |
| 72 | 7 | DB | TB | 170,939,860 | 173,381,857 | 2,441,998 | 0.009097151 | 0 |
| 73 | 7 | 7 | – | 173,381,858 | 175,823,855 | 2,441,998 | 0.009097151 | 0 |
| 74 | 7 | 7 | Ba | 175,823,856 | 178,265,853 | 2,441,998 | 0.009097151 | 0 |
| 75 | 7 | 7 | DB | 178,265,854 | 180,707,851 | 2,441,998 | 0.009097151 | 0 |
| 76 | 7 | 7 | TB | 180,707,852 | 183,149,849 | 2,441,998 | 0.009097151 | 0 |
| 77 | 7 | TB | – | 183,149,850 | 185,591,847 | 2,441,998 | 0.009097151 | 0 |
| 78 | 7 | TB | Ba | 185,591,848 | 188,033,845 | 2,441,998 | 0.009097151 | 0 |
| 79 | 7 | TB | DB | 188,033,846 | 190,475,843 | 2,441,998 | 0.009097151 | 0 |
| 80 | 7 | TB | 7 | 190,475,844 | 192,917,841 | 2,441,998 | 0.009097151 | 0 |
| 81 | 7 | TB | TB | 192,917,842 | 195,359,839 | 2,441,998 | 0.009097151 | 0 |
| 82 | TB | – | – | 195,359,840 | 197,801,837 | 2,441,998 | 0.009097151 | 0 |
| 83 | TB | – | Ba | 197,801,838 | 200,243,835 | 2,441,998 | 0.009097151 | 0 |
| 84 | TB | – | DB | 200,243,836 | 202,685,833 | 2,441,998 | 0.009097151 | 0 |
| 85 | TB | – | 7 | 202,685,834 | 205,127,831 | 2,441,998 | 0.009097151 | 0 |
| 86 | TB | – | TB | 205,127,832 | 207,569,829 | 2,441,998 | 0.009097151 | 0 |
| 87 | TB | Ba | – | 207,569,830 | 210,011,827 | 2,441,998 | 0.009097151 | 0 |
| 88 | TB | Ba | 7 | 210,011,828 | 212,453,825 | 2,441,998 | 0.009097151 | 0 |

FIG. 23B

| | Reel 1 | Reel 2 | Reel 3 | Subset From | Subset To | Weight | Probability | Payout |
|---|---|---|---|---|---|---|---|---|
| 89 | TB | DB | – | 212,453,826 | 214,895,823 | 2,441,998 | 0.009097151 | 0 |
| 90 | TB | DB | 7 | 214,895,824 | 217,337,821 | 2,441,998 | 0.009097151 | 0 |
| 91 | TB | 7 | – | 217,337,822 | 219,779,819 | 2,441,998 | 0.009097151 | 0 |
| 92 | TB | 7 | Ba | 219,779,820 | 222,221,817 | 2,441,998 | 0.009097151 | 0 |
| 93 | TB | 7 | DB | 222,221,818 | 224,663,815 | 2,441,998 | 0.009097151 | 0 |
| 94 | TB | 7 | 7 | 224,663,816 | 227,105,813 | 2,441,998 | 0.009097151 | 0 |
| 95 | TB | 7 | TB | 227,105,814 | 229,547,811 | 2,441,998 | 0.009097151 | 0 |
| 96 | TB | TB | – | 229,547,812 | 231,989,809 | 2,441,998 | 0.009097151 | 0 |
| 97 | TB | TB | 7 | 231,989,810 | 234,431,807 | 2,441,998 | 0.009097151 | 0 |
| 98 | – | – | Ch | 234,431,808 | 234,685,329 | 253,522 | 0.000944443 | 3 |
| 99 | – | Ba | Ch | 234,685,330 | 234,938,851 | 253,522 | 0.000944443 | 3 |
| 100 | – | Ch | – | 234,938,852 | 235,192,373 | 253,522 | 0.000944443 | 3 |
| 101 | – | Ch | Ba | 235,192,374 | 235,445,895 | 253,522 | 0.000944443 | 3 |
| 102 | – | Ch | Ch | 235,445,896 | 236,079,701 | 633,806 | 0.002361111 | 6 |
| 103 | – | Ch | DB | 236,079,702 | 236,333,223 | 253,522 | 0.000944443 | 3 |
| 104 | – | Ch | 7 | 236,333,224 | 236,586,745 | 253,522 | 0.000944443 | 3 |
| 105 | – | Ch | TB | 236,586,746 | 236,840,267 | 253,522 | 0.000944443 | 3 |
| 106 | – | DB | Ch | 236,840,268 | 237,093,789 | 253,522 | 0.000944443 | 3 |
| 107 | – | 7 | Ch | 237,093,790 | 237,347,311 | 253,522 | 0.000944443 | 3 |
| 108 | – | TB | Ch | 237,347,312 | 237,600,833 | 253,522 | 0.000944443 | 3 |
| 109 | Ba | – | Ch | 237,600,834 | 237,854,355 | 253,522 | 0.000944443 | 3 |
| 110 | Ba | Ba | Ba | 237,854,356 | 238,805,064 | 950,709 | 0.003541667 | 20 |
| 111 | Ba | Ba | Ch | 238,805,065 | 239,058,586 | 253,522 | 0.000944443 | 3 |
| 112 | Ba | Ba | DB | 239,058,587 | 239,157,618 | 99,032 | 0.000368923 | 8 |
| 113 | Ba | Ba | TB | 239,157,619 | 239,256,650 | 99,032 | 0.000368923 | 8 |
| 114 | Ba | Ch | – | 239,256,651 | 239,510,172 | 253,522 | 0.000944443 | 3 |
| 115 | Ba | Ch | Ba | 239,510,173 | 239,763,694 | 253,522 | 0.000944443 | 3 |
| 116 | Ba | Ch | Ch | 239,763,695 | 240,397,500 | 633,806 | 0.002361111 | 6 |
| 117 | Ba | Ch | DB | 240,397,501 | 240,651,022 | 253,522 | 0.000944443 | 3 |
| 118 | Ba | Ch | 7 | 240,651,023 | 240,904,544 | 253,522 | 0.000944443 | 3 |
| 119 | Ba | Ch | TB | 240,904,545 | 241,158,066 | 253,522 | 0.000944443 | 3 |
| 120 | Ba | DB | Ba | 241,158,067 | 241,257,098 | 99,032 | 0.000368923 | 8 |
| 121 | Ba | DB | Ch | 241,257,099 | 241,510,620 | 253,522 | 0.000944443 | 3 |
| 122 | Ba | DB | DB | 241,510,621 | 241,609,652 | 99,032 | 0.000368923 | 8 |
| 123 | Ba | DB | TB | 241,609,653 | 241,708,684 | 99,032 | 0.000368923 | 8 |
| 124 | Ba | 7 | Ch | 241,708,685 | 241,962,206 | 253,522 | 0.000944443 | 3 |
| 125 | Ba | TB | Ba | 241,962,207 | 242,061,238 | 99,032 | 0.000368923 | 8 |
| 126 | Ba | TB | Ch | 242,061,239 | 242,314,760 | 253,522 | 0.000944443 | 3 |
| 127 | Ba | TB | DB | 242,314,761 | 242,413,792 | 99,032 | 0.000368923 | 8 |
| 128 | Ba | TB | TB | 242,413,793 | 242,512,824 | 99,032 | 0.000368923 | 8 |
| 129 | Ch | – | – | 242,512,825 | 242,766,346 | 253,522 | 0.000944443 | 3 |
| 130 | Ch | – | Ba | 242,766,347 | 243,019,868 | 253,522 | 0.000944443 | 3 |
| 131 | Ch | – | Ch | 243,019,869 | 243,653,674 | 633,806 | 0.002361111 | 6 |
| 132 | Ch | – | DB | 243,653,675 | 243,907,196 | 253,522 | 0.000944443 | 3 |

FIG. 23c

| | Reel 1 | Reel 2 | Reel 3 | Subset From | Subset To | Weight | Probability | Payout |
|---|---|---|---|---|---|---|---|---|
| 133 | Ch | – | 7 | 243,907,197 | 244,160,718 | 253,522 | 0.000944443 | 3 |
| 134 | Ch | – | TB | 244,160,719 | 244,414,240 | 253,522 | 0.000944443 | 3 |
| 135 | Ch | Ba | – | 244,414,241 | 244,667,762 | 253,522 | 0.000944443 | 3 |
| 136 | Ch | Ba | Ba | 244,667,763 | 244,921,284 | 253,522 | 0.000944443 | 3 |
| 137 | Ch | Ba | Ch | 244,921,285 | 245,555,090 | 633,806 | 0.002361111 | 6 |
| 138 | Ch | Ba | DB | 245,555,091 | 245,808,612 | 253,522 | 0.000944443 | 3 |
| 139 | Ch | Ba | 7 | 245,808,613 | 246,062,134 | 253,522 | 0.000944443 | 3 |
| 140 | Ch | Ba | TB | 246,062,135 | 246,315,656 | 253,522 | 0.000944443 | 3 |
| 141 | Ch | Ch | – | 246,315,657 | 246,949,462 | 633,806 | 0.002361111 | 6 |
| 142 | Ch | Ch | Ba | 246,949,463 | 247,583,268 | 633,806 | 0.002361111 | 6 |
| 143 | Ch | Ch | Ch | 247,583,269 | 249,167,783 | 1,584,515 | 0.005902778 | 12 |
| 144 | Ch | Ch | DB | 249,167,784 | 249,801,589 | 633,806 | 0.002361111 | 6 |
| 145 | Ch | Ch | 7 | 249,801,590 | 250,435,395 | 633,806 | 0.002361111 | 6 |
| 146 | Ch | Ch | TB | 250,435,396 | 251,069,201 | 633,806 | 0.002361111 | 6 |
| 147 | Ch | DB | – | 251,069,202 | 251,322,723 | 253,522 | 0.000944443 | 3 |
| 148 | Ch | DB | Ba | 251,322,724 | 251,576,245 | 253,522 | 0.000944443 | 3 |
| 149 | Ch | DB | Ch | 251,576,246 | 252,210,051 | 633,806 | 0.002361111 | 6 |
| 150 | Ch | DB | DB | 252,210,052 | 252,463,573 | 253,522 | 0.000944443 | 3 |
| 151 | Ch | DB | 7 | 252,463,574 | 252,717,095 | 253,522 | 0.000944443 | 3 |
| 152 | Ch | DB | TB | 252,717,096 | 252,970,617 | 253,522 | 0.000944443 | 3 |
| 153 | Ch | 7 | – | 252,970,618 | 253,224,139 | 253,522 | 0.000944443 | 3 |
| 154 | Ch | 7 | Ba | 253,224,140 | 253,477,661 | 253,522 | 0.000944443 | 3 |
| 155 | Ch | 7 | Ch | 253,477,662 | 254,111,467 | 633,806 | 0.002361111 | 6 |
| 156 | Ch | 7 | DB | 254,111,468 | 254,364,989 | 253,522 | 0.000944443 | 3 |
| 157 | Ch | 7 | 7 | 254,364,990 | 254,618,511 | 253,522 | 0.000944443 | 3 |
| 158 | Ch | 7 | TB | 254,618,512 | 254,872,033 | 253,522 | 0.000944443 | 3 |
| 159 | Ch | TB | – | 254,872,034 | 255,125,555 | 253,522 | 0.000944443 | 3 |
| 160 | Ch | TB | Ba | 255,125,556 | 255,379,077 | 253,522 | 0.000944443 | 3 |
| 161 | Ch | TB | Ch | 255,379,078 | 256,012,883 | 633,806 | 0.002361111 | 6 |
| 162 | Ch | TB | DB | 256,012,884 | 256,266,405 | 253,522 | 0.000944443 | 3 |
| 163 | Ch | TB | 7 | 256,266,406 | 256,519,927 | 253,522 | 0.000944443 | 3 |
| 164 | Ch | TB | TB | 256,519,928 | 256,773,449 | 253,522 | 0.000944443 | 3 |
| 165 | DB | – | Ch | 256,773,450 | 257,026,971 | 253,522 | 0.000944443 | 3 |
| 166 | DB | Ba | Ba | 257,026,972 | 257,126,003 | 99,032 | 0.000368923 | 8 |
| 167 | DB | Ba | Ch | 257,126,004 | 257,379,525 | 253,522 | 0.000944443 | 3 |
| 168 | DB | Ba | DB | 257,379,526 | 257,478,557 | 99,032 | 0.000368923 | 8 |
| 169 | DB | Ba | TB | 257,478,558 | 257,577,589 | 99,032 | 0.000368923 | 8 |
| 170 | DB | Ch | – | 257,577,590 | 257,831,111 | 253,522 | 0.000944443 | 3 |
| 171 | DB | Ch | Ba | 257,831,112 | 258,084,633 | 253,522 | 0.000944443 | 3 |
| 172 | DB | Ch | Ch | 258,084,634 | 258,718,439 | 633,806 | 0.002361111 | 6 |
| 173 | DB | Ch | DB | 258,718,440 | 258,971,961 | 253,522 | 0.000944443 | 3 |
| 174 | DB | Ch | 7 | 258,971,962 | 259,225,483 | 253,522 | 0.000944443 | 3 |
| 175 | DB | Ch | TB | 259,225,484 | 259,479,005 | 253,522 | 0.000944443 | 3 |
| 176 | DB | DB | Ba | 259,479,006 | 259,578,037 | 99,032 | 0.000368923 | 8 |

FIG. 23D

| | Reel 1 | Reel 2 | Reel 3 | Subset From | Subset To | Weight | Probability | Payout |
|---|---|---|---|---|---|---|---|---|
| 177 | DB | DB | Ch | 259,578,038 | 259,831,559 | 253,522 | 0.000944443 | 3 |
| 178 | DB | DB | DB | 259,831,560 | 260,211,843 | 380,284 | 0.001416668 | 50 |
| 179 | DB | DB | TB | 260,211,844 | 260,310,875 | 99,032 | 0.000368923 | 8 |
| 180 | DB | 7 | Ch | 260,310,876 | 260,564,397 | 253,522 | 0.000944443 | 3 |
| 181 | DB | TB | Ba | 260,564,398 | 260,663,429 | 99,032 | 0.000368923 | 8 |
| 182 | DB | TB | Ch | 260,663,430 | 260,916,951 | 253,522 | 0.000944443 | 3 |
| 183 | DB | TB | DB | 260,916,952 | 261,015,983 | 99,032 | 0.000368923 | 8 |
| 184 | DB | TB | TB | 261,015,984 | 261,115,015 | 99,032 | 0.000368923 | 8 |
| 185 | 7 | – | Ch | 261,115,016 | 261,368,537 | 253,522 | 0.000944443 | 3 |
| 186 | 7 | Ba | Ch | 261,368,538 | 261,622,059 | 253,522 | 0.000944443 | 3 |
| 187 | 7 | Ch | – | 261,622,060 | 261,875,581 | 253,522 | 0.000944443 | 3 |
| 188 | 7 | Ch | Ba | 261,875,582 | 262,129,103 | 253,522 | 0.000944443 | 3 |
| 189 | 7 | Ch | Ch | 262,129,104 | 262,762,909 | 633,806 | 0.002361111 | 6 |
| 190 | 7 | Ch | DB | 262,762,910 | 263,016,431 | 253,522 | 0.000944443 | 3 |
| 191 | 7 | Ch | 7 | 263,016,432 | 263,269,953 | 253,522 | 0.000944443 | 3 |
| 192 | 7 | Ch | TB | 263,269,954 | 263,523,475 | 253,522 | 0.000944443 | 3 |
| 193 | 7 | DB | Ch | 263,523,476 | 263,776,997 | 253,522 | 0.000944443 | 3 |
| 194 | 7 | 7 | Ch | 263,776,998 | 264,030,519 | 253,522 | 0.000944443 | 3 |
| 195 | 7 | 7 | 7 | 264,030,520 | 264,030,538 | 19 | 0.000000071 | 1000000 |
| 196 | 7 | TB | Ch | 264,030,539 | 264,284,060 | 253,522 | 0.000944443 | 3 |
| 197 | TB | – | Ch | 264,284,061 | 264,537,582 | 253,522 | 0.000944443 | 3 |
| 198 | TB | Ba | Ba | 264,537,583 | 264,636,614 | 99,032 | 0.000368923 | 8 |
| 199 | TB | Ba | Ch | 264,636,615 | 264,890,136 | 253,522 | 0.000944443 | 3 |
| 200 | TB | Ba | DB | 264,890,137 | 264,989,168 | 99,032 | 0.000368923 | 8 |
| 201 | TB | Ba | TB | 264,989,169 | 265,088,200 | 99,032 | 0.000368923 | 8 |
| 202 | TB | Ch | -- | 265,088,201 | 265,341,722 | 253,522 | 0.000944443 | 3 |
| 203 | TB | Ch | Ba | 265,341,723 | 265,595,244 | 253,522 | 0.000944443 | 3 |
| 204 | TB | Ch | Ch | 265,595,245 | 266,229,050 | 633,806 | 0.002361111 | 6 |
| 205 | TB | Ch | DB | 266,229,051 | 266,482,572 | 253,522 | 0.000944443 | 3 |
| 206 | TB | Ch | 7 | 266,482,573 | 266,736,094 | 253,522 | 0.000944443 | 3 |
| 207 | TB | Ch | TB | 266,736,095 | 266,989,616 | 253,522 | 0.000944443 | 3 |
| 208 | TB | DB | Ba | 266,989,617 | 267,088,648 | 99,032 | 0.000368923 | 8 |
| 209 | TB | DB | Ch | 267,088,649 | 267,342,170 | 253,522 | 0.000944443 | 3 |
| 210 | TB | DB | DB | 267,342,171 | 267,441,202 | 99,032 | 0.000368923 | 8 |
| 211 | TB | DB | TB | 267,441,203 | 267,540,234 | 99,032 | 0.000368923 | 8 |
| 212 | TB | 7 | Ch | 267,540,235 | 267,793,756 | 253,522 | 0.000944443 | 3 |
| 213 | TB | TB | Ba | 267,793,757 | 267,892,788 | 99,032 | 0.000368923 | 8 |
| 214 | TB | TB | Ch | 267,892,789 | 268,146,310 | 253,522 | 0.000944443 | 3 |
| 215 | TB | TB | DB | 268,146,311 | 268,245,342 | 99,032 | 0.000368923 | 8 |
| 216 | TB | TB | TB | 268,245,343 | 268,435,455 | 190,113 | 0.000708226 | 100 |
| | | | | | | 268,435,456 | 1.000000000 | |

FIG. 23E

REEL TYPE SLOT MACHINE UTILIZING RANDOM NUMBER GENERATOR FOR SELECTING GAME RESULT

SPECIFICATION

This is a continuation-in-part of U.S. application Ser. No. 08/876,046, filed Jun. 13, 1997, now abandoned.

BACKGROUND OF THE INVENTION

The present invention relates to reel-type slot machines, and more particularly to reel-type slot machines having multiple display reels each bearing a plurality of different game symbols, wherein the reels are driven to display game symbols selected for each reel by a random number generator and look-up table. An undesired game result may be avoided by reducing or omitting it from the look-up table.

In recent years reel-type slot machines have evolved from mechanical type machines wherein mechanical clutches were relied on to stop spinning display reels at random locations to display a game result, to electronic type machines wherein a microprocessor randomly selects a game result, and the display reels are driven to reel positions wherein game symbols on the reels display the game result. The present invention is directed to an improvement in such an electronic type slot machine wherein a random number generator randomly selects a number within a predetermined set of random numbers, the randomly selected number is associated with a game symbol for each reel within a look-up table, and each reel is positioned to display its respective game symbol. By providing a greater number of random numbers in the random number set than the number of available sets of different symbol combinations which can be displayed on the reels, and by varying the sizes of the subsets of random numbers which correspond to each different set of game symbols, the probability of a particular game result occurring can be predetermined for the machine. An undesirable game result can be avoided by reducing its subset to zero.

In electronic reel type slot machines the reels are typically positioned by stepper motors, which may be contained in removable modules within the machine. The stepper motors respond to applied signals which are progressively phase-shifted relative to each other such that the stepper motors are caused to turn one element of rotation for each progression of the phase signals.

The phase signals are typically generated in motor drive circuits, which respond to applied motor stepping pulses to advance the reels in increments. The motor stepping pulses are generated by a microprocessor, a predetermined number of pulses being applied to the motor drive circuits to cause each motor to be incremented to a selected stopping position wherein the game result is displayed by the display reels. In prior slot machine designs, the stopping positions were typically determined by the microprocessor by either counting the number of motor pulses occurring after a "home" marker on the reel had passed a fixed sensor, or by counting markers provided on the reel for each symbol position after the home marker had passed.

In contrast, the present invention is directed to a reel-type slot machine wherein in response to a play command the microprocessor selects a random number within a predetermined set of random numbers, the selected random number is associated with game symbols within a memory device providing a look-up table, and the display reels are rotated to display the game symbols.

Accordingly, it is a general object of the present invention to provide a new and improved reel-type slot machine.

It is a more specific object of the present invention to provide a reel-type slot machine wherein game symbols to be displayed are selected by a random number generator operating in conjunction with a look-up table, and the display reels are driven by stepper motors to display the selected game symbols.

SUMMARY OF THE INVENTION

The invention is directed to a reel-type slot machine comprising a user actuated spin switch for providing a play command, at least one display reel having a plurality of different game symbols thereon, the display reel being rotatably mounted to selectively display one of the game symbols, reel drive means responsive to the play command for rotatably driving said display reel, selection means responsive to the play command for randomly generating a random number from a predetermined set of random numbers, memory means for establishing a game result from a predetermined set of potential game results for each random number in the set of random numbers, each of the game results requiring display of an associated game symbol, the memory means providing a display signal indicative of the game symbol, and display control means responsive to the display signal for causing the reel drive means to position the display reel to display the associated game symbol. The invention is further directed to a reel-type slot machine comprising a user actuated spin switch for providing a play command, a plurality of display reels each having a plurality of different game symbols thereon, the display reels being rotatably mounted to each selectively display one of the game symbols, reel drive means responsive to the play command for rotatably driving the reels, selection means responsive to the play command for randomly generating a random number from a predetermined set of random numbers, memory means for establishing a game result from a predetermined set of potential game results for each random number in the set of random numbers, each of the game results requiring display of associated game symbols on the display reels, the memory means providing a display signal for each reel indicative of the game symbol to be displayed by that reel, and display control means responsive to the display signals for causing the reel drive means to position the display reels to display the associated game symbols.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

FIG. 1 is a perspective view of a reel-type slot machine constructed in accordance with the invention.

FIG. 2 is a perspective view of the slot machine of FIG. 1 with its cabinet open to show the principal components of the machine.

FIG. 3 is a perspective view of one of the removable reel assemblies utilized in the slot machine of FIGS. 1 and 2.

FIGS. 10A–10E depict a table showing the association between random numbers and game results in the slot machine of FIGS. 1 and 2.

FIGS. 23A–23E depict a table similar to that of FIGS. 10A–10E wherein the probability of an undesired game result occurring has been reduced to zero.

DESCRIPTION OF THE PREFERRED EMBODIMENT

Figure 4:
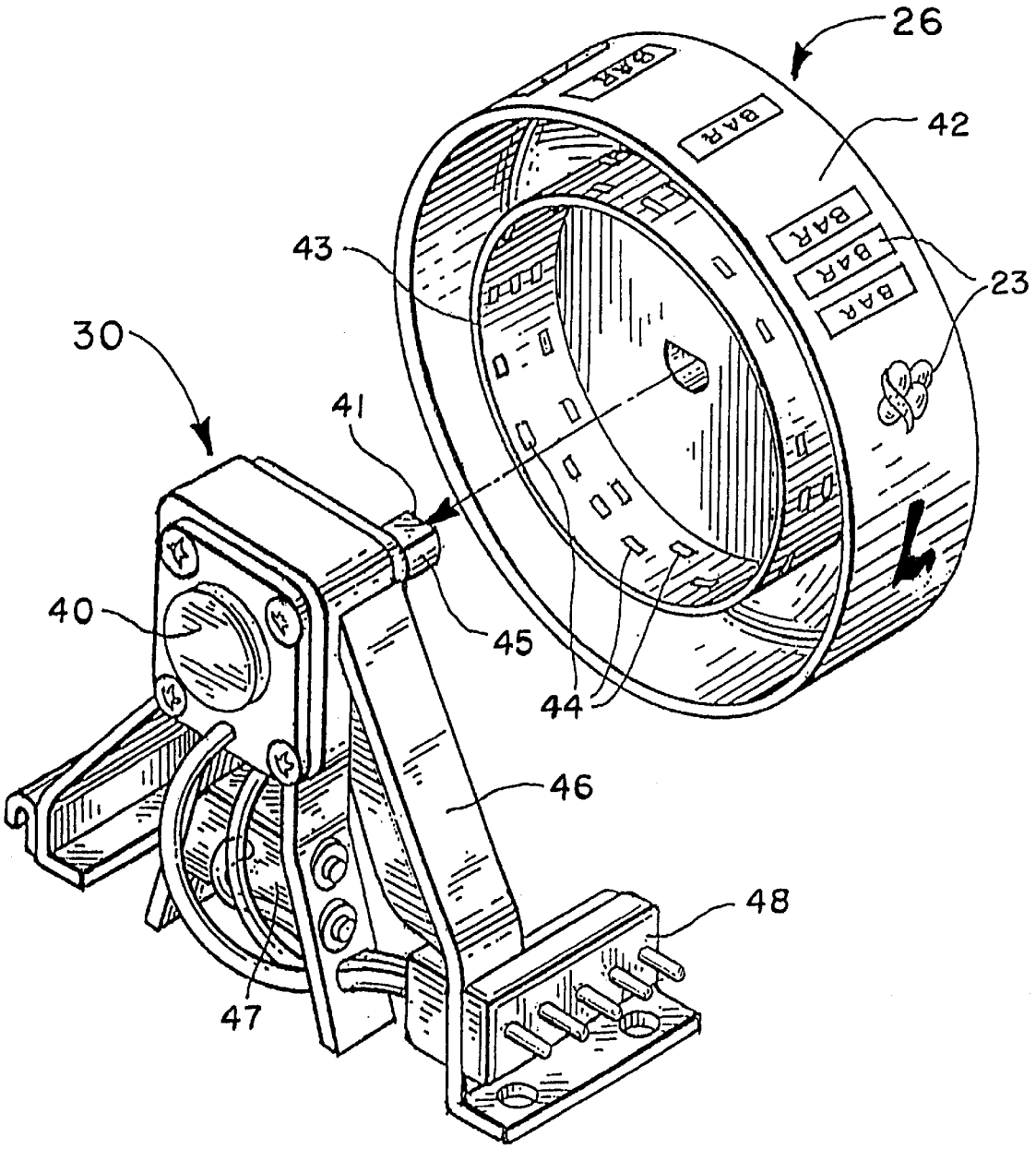
FIG. 4 is an enlarged exploded view of the reel assembly of FIG. 3.

Referring to the drawings, and particularly to FIGS. 1 and 2, a reel-type slot machine 20 constructed in accordance with the invention is seen to include a cabinet 21 having a display window 22. Game symbols 23–25 contained on respective reels 26–28 (FIG. 2) of individual plug-in reel assemblies 30–32 are visible on a pay line 29 through the window. It will be understood that the slot machine can be constructed with a greater or lesser number of display reels.

In accordance with conventional design slot machine 20 includes a coin slot 33 (FIG. 1) for receiving coins, a tray 34 for dispensing coins, and a user-actuated play handle 35 for initiating game play. Within cabinet 21 slot machine 20 further includes a coin dispensing unit 36 (FIG. 2) of conventional design and an electronic game control module 37 for controlling game operation. As will be described presently, this module among its other control functions provides drive signals to reel assemblies 30–32 to cause reels 26–28 to display game symbols corresponding to a particular game result on pay line 29.

Referring to FIGS. 3–6, reel assembly 30, which may be identical to the other reel assemblies except possibly for its symbol make-up, is seen to include a stepper motor 40 having a shaft 41 on which display reel 26 is received. The reel includes an outer rim portion 42 on which game symbols 23 are contained, and an inner rim portion 43 concentric with the outer portion on which symbol-indicating indicia in the form of a plurality of apertures 44 arranged side-by-side in three columns. The two reel portions 42 and 43 are carried on shaft 41 at a fixed angular position relative to each other. In a preferred form, the entire display reel 26 is formed as a single piece which can be conveniently installed on and removed from shaft 41. A flat 45 may be formed on shaft 41 to provide positive rotational coupling between stepper motor 40 and the reel.

A generally A-shaped frame 46 is provided to position motor 40 such that one symbol position on the outer rim portion 42 can be seen on pay line 29 through window 22 when reel assembly 30 is installed in cabinet 21. A detector assembly 47 on frame 46 operates in conjunction with the indicia 44 on the inner rim portion 43 to identify the game symbols as they approach window 22. An electrical connector 48 is provided on one leg of frame 46 to enable electrical connections to be made with the reel assembly when the reel assembly is installed in cabinet 21.

Figure 6:
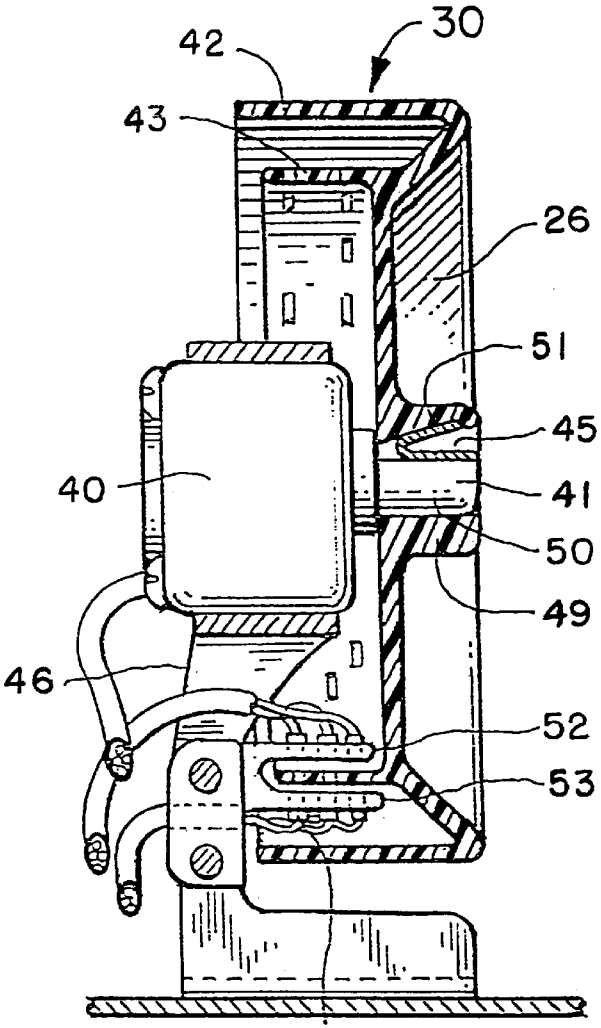
FIG. 6 is a side cross-sectional view of the reel assembly taken along line 6—6 of FIG. 5.
Figure 5:
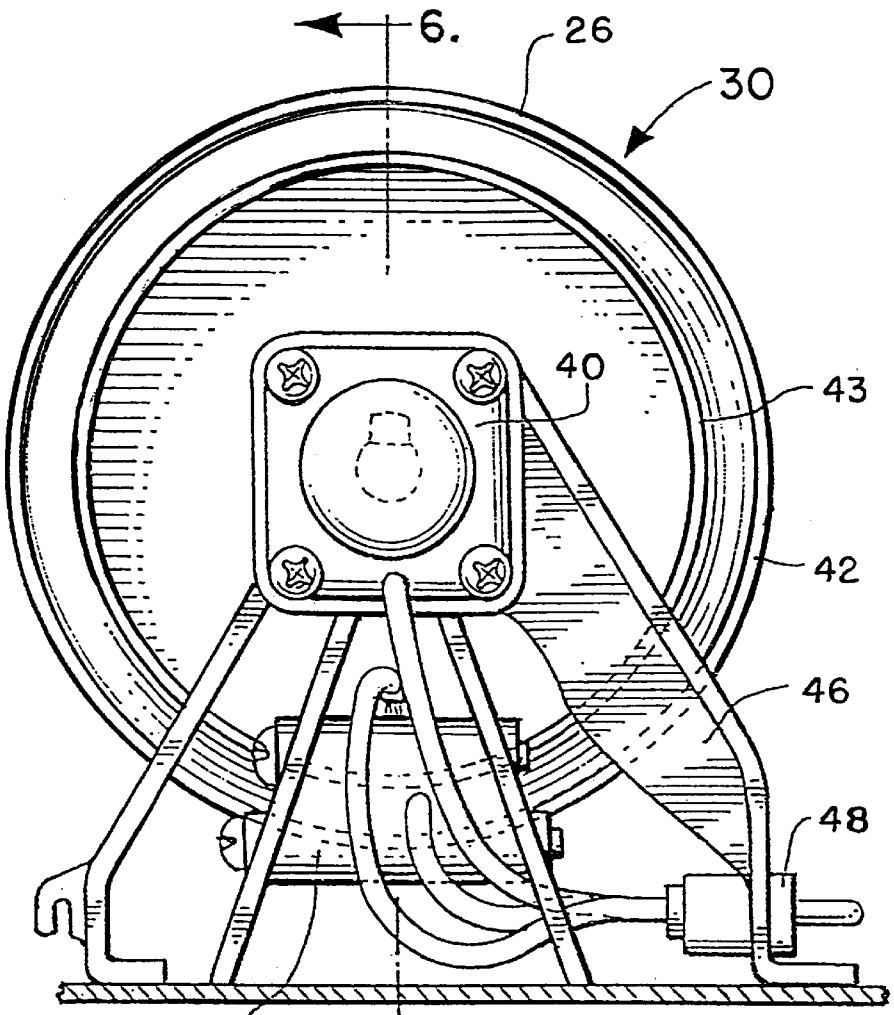
FIG. 5 is an enlarged front view of the reel assembly of FIGS. 3 and 4.

As shown in FIG. 6, reel 26 includes a hub portion 49 which is received over motor shaft 41. An aperture 50 in the hub portion receives the motor shaft. A spring 51 within the hub portion engages the flat 45 on the shaft to secure the hub on the shaft, and prevent independent reel rotation. Alternatively, a set screw may be provided in the hub portion for the same purpose.

Detector assembly 47 is seen in FIG. 6 to include a housing having two projecting portions 52 and 53 which form a slot 54 through which the inner rim portion 43 passes. The upper portion 52 includes three light sources in the form of LEDs 55*a*–55*c* and the lower portion 53 includes three photodetectors 56*a*–56*c*. LEDs 55*a*–55*c* and detectors 56*a*–56*c* are aligned with rim portion 43 such that the three columns of symbol-indicating apertures 44 contained thereon pass between respective paired LEDs and detectors with rotation of the reel. In this way, the passage of each set of apertures is sensed, and, in a manner to be explained, the game control circuits determine when a particular game symbol is about to be displayed in window 22.

Figure 7:
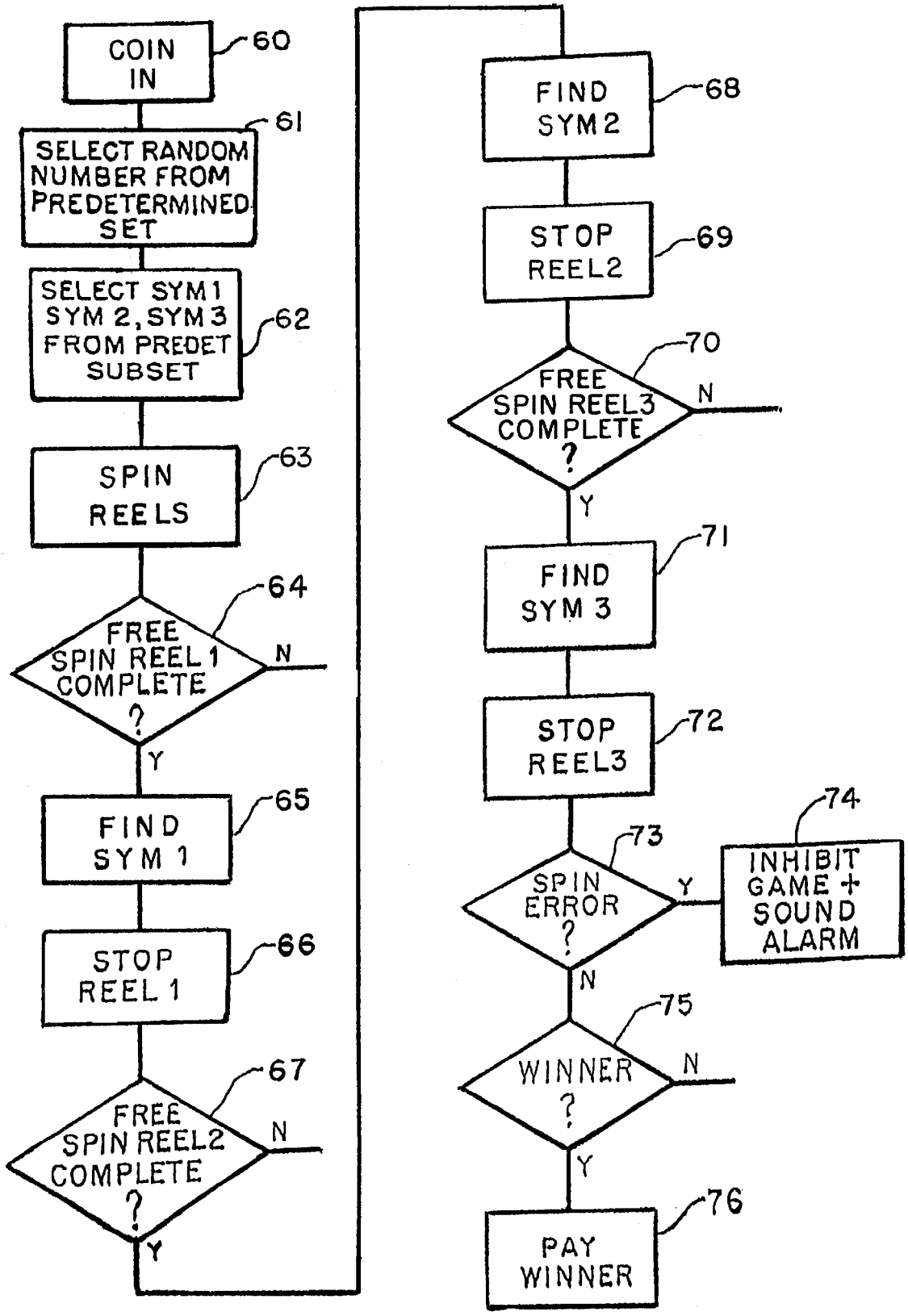
FIG. 7 is a functional block diagram illustrating the operation of the slot machine of FIGS. 1 and 2.

The basic operation of slot machine 20 is functionally illustrated in FIG. 7. First, at 60 a coin is received. Then, at 61, if the machine has not been inhibited as a result of a malfunction or tampering, the microprocessor-driven game control circuits, utilizing a conventional stored algorithm, generate a random number within a predetermined range of random numbers. For example, in a 28 bit system the number may be one of 268,435,456 numbers in a range of 0 to 268,435,455. Then, at 62 this number is utilized in conjunction with a stored look-up table in an EPROM or similar memory device to select a game result comprising, in this three reel embodiment, three game symbols SYM1, SYM2 and SYM3.

Next, at 63 all three reels are caused to spin. The first reel 26 continues to spin for a first predetermined free spin period, typically one second, and upon completion of this period at 64 a stopping procedure is initiated at 65 whereby signals developed by the game symbol-indicating apertures 44 passing detector 47 are compared with signals corresponding to the desired game symbol SYM1. When a comparison is realized, the application of normal drive signals to stepper motor 40 is interrupted and a stop routine is initiated at 66 to stop the display reel with the desired symbol displayed.

In the meantime the second display reel 27 continues to spin, and upon completion of a second predetermined spin period, also typically one second, at 67 following the stopping of reel 26 the signals generated by the symbol-indicating apertures on reel 2 are compared at 68 with signals corresponding to the desired game symbol SYM2 for reel 27, and upon occurrence of a comparison a stop routine is initiated at 69 to cause reel 27 to stop with the desired game symbol for that reel displayed. Similarly, the third display reel 28 continues to spin through a third one second predetermined free spin period at 70 following the stopping of reel 27 until at 71 a comparison of the signals generated by the symbol-indicating apertures 44 thereon with a signal corresponding to the desired symbol to be displayed on the reel is obtained and a stop routine 72 causes the reel to stop with the intended game symbol displayed through window 22 on pay line 29.

In the event that a spin error has occurred in the positioning of any one of the three reels, either as a result of the stepper motor slipping or failing to step in response to a stepper pulse, or a reel having been moved in the absence of stepper pulses, the monitoring system signals a spin error at 73, an alarm is sounded and the game is inhibited at 74. In the absence of a spin error, a determination is made at 75 whether the game results constitute a win, and if so the hopper mechanism 36 is actuated to accomplish a payout at 76.

Figure 8:
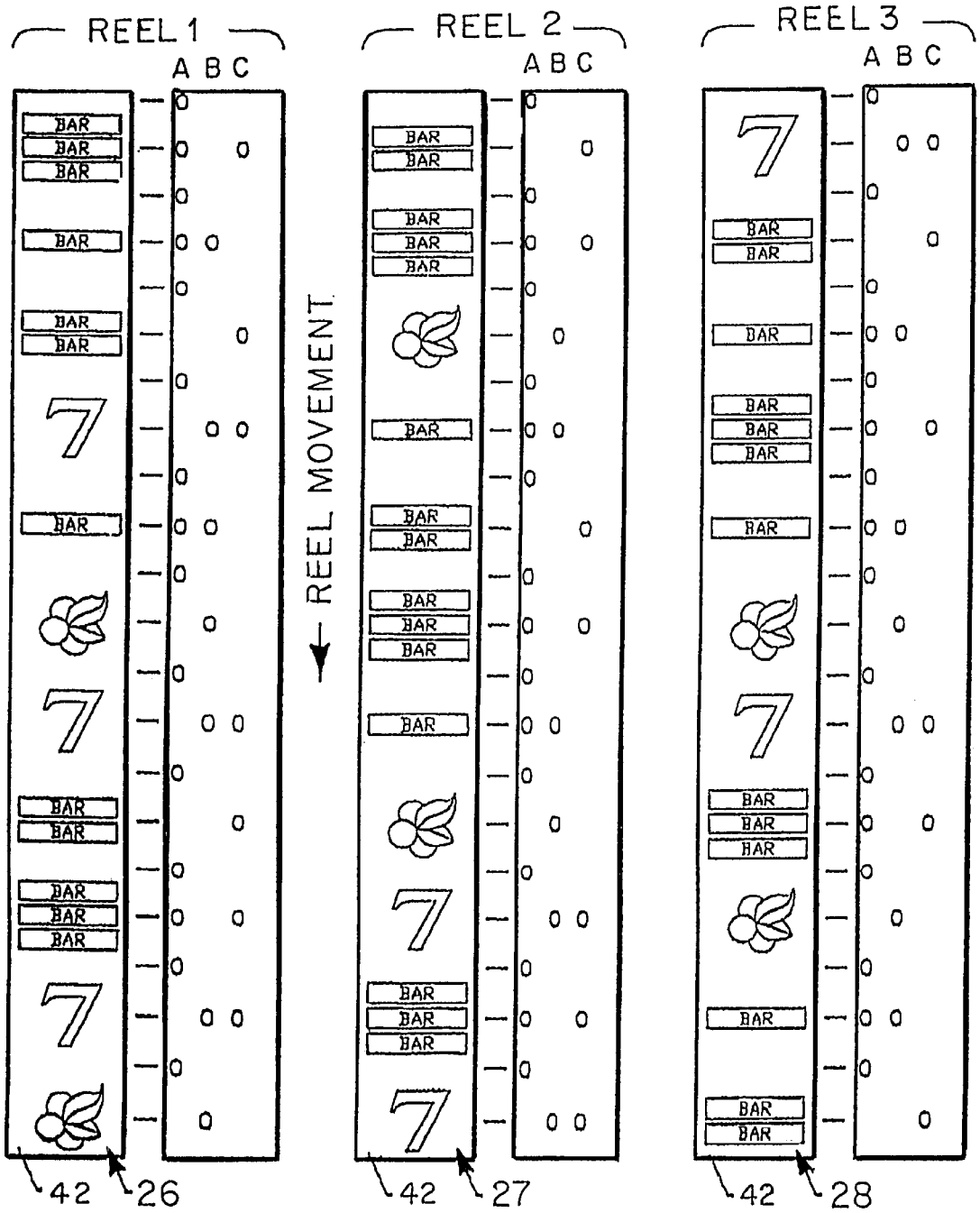
FIG. 8 is an illustration of a representative arrangement of game symbols and game symbol-indicating indicia on the three display reels of the slot machine of FIGS. 1 and 2.

One form of display reel make-up is shown in FIG. 8. Here each of the three display reels 26–28 has 22 display positions, containing 11 blank symbols and 11 non-blank game symbols. The symbols appear on the outer rim portions 42 of the reels in alternation, a blank game symbol appearing between each pair of consecutive non-blank game symbols.

Indicia comprising a three bit binary code is associated with each symbol by the provision of thin slit-shaped apertures on the inner rim portion 43 of each display reel. These binary codes are unique to their associated symbol or blank, and are arranged in three columns A–C around the reel rim portions 43.

Although for clarity no angular displacement is shown between the symbols and their associated codes, in practice the angular displacement of the leading edge of the codes to the symbols may range from 0° to 180°, depending on the location of sensors 47 relative to the pay line, and on the angular rotation required to stop the reel. In the illustrated embodiment, for example, where the sensors are displaced 115° from the pay line, if the stepper motor is large and requires a relatively small number of steps per rotation, 48 for example, the stop is essentially instantaneous and the displacement is 115°. However, if a ramp down procedure such as that to be later described is used, and the ramp-down routine requires, for example, 40° of rotation, the displacement is 155° (115°+40°).

While the illustrated reel set shows 22 symbol positions with 11 blank game symbols and 11 non-blank game symbols of 6 different types (e.g., for reel 30; two triple bars, two double bars, two single bars, two cherries, 3 sevens), it will be appreciated that a greater or lesser number of symbol positions can be provided with a greater or lesser number of symbols and symbol types.

Figure 9:
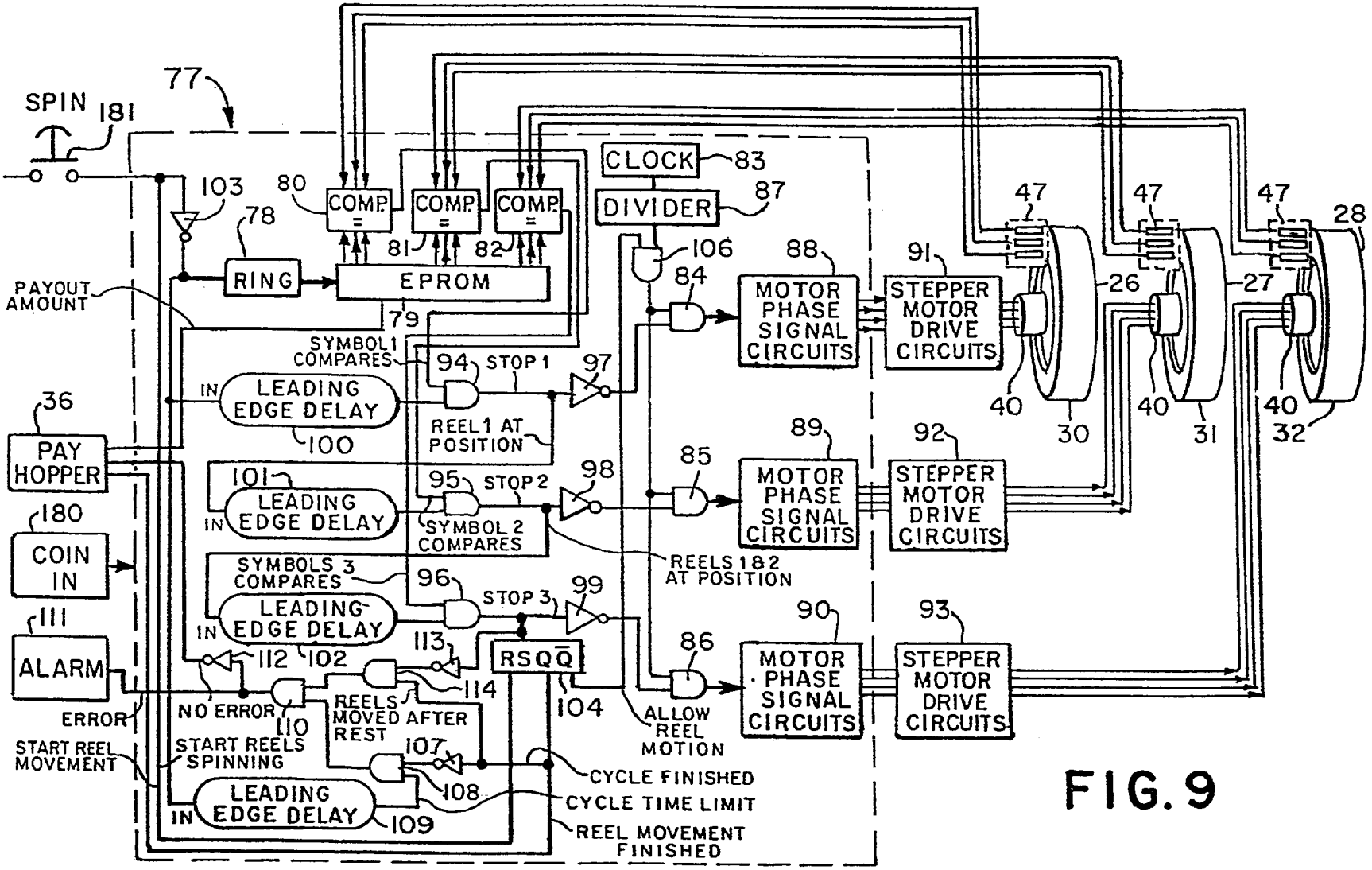
FIG. 9 is a simplified schematic diagram partly in functional form illustrating the operation of the slot machine of FIGS. 1 and 2.

The functioning of slot machine 20 is illustrated in FIG. 9. Game control circuits 37 (FIG. 2), which typically include a microprocessor and associated memory and input-output circuits depicted functionally in FIG. 9 as game circuits 77, receive signals from a conventional coin-in detector 180 and a conventional spin switch 181, which may be either a panel-mounted push button switch or a switch actuated by play handle 35. The microprocessor, utilizing a stored random number generating algorithm, the function of which is generally designated in FIG. 9 by a random number generator 78 (RNG), generates a random number which may be, for example, in a 28 bit system one of 268,435,456 possibilities within a predetermined range of 0 to 268,435,455. This number is applied to a memory device 79, preferably taking the form of a plug-in EPROM 79, in which a look-up table has been stored.

The look-up table contains a specific game result in the form of a game symbol to be displayed (blank, 7, bar, double bar, triple bar, or cherry) for each reel for each applied random number. The game result symbols are each separately output from the EPROM as three bit binary signals which is applied to respective ones of three comparators 80–82.

When enabling signals are applied to AND gates 84–86, stepper pulses generated by a clock 83 and a divider 87 are applied to individual motor phase signal generating circuits 88–90 associated with reel assemblies 30–32, respectively. Circuits 88–90 provide progressively advancing quadrature phase signals in response to the applied stepper pulses to stepper motor drive circuits 91–93, respectively. The outputs of each drive circuit are applied to the four stator windings of the associated stepper motor 40 in a conventional manner whereby the stepper motor is caused to incrementally rotate in response to each stepper pulse.

As display reels 26–28 rotate the detectors 47 associated with each reel read the game symbol-indicating apertures 44 on the reels. Upon completion of the respective free spin periods of the reels, signals developed by detectors 47 from the passing apertures 44 are compared in comparators 80–82 with signals corresponding to the desired game result symbols, as supplied to those comparators by the look-up table in EPROM 79. When a comparison is realized, an inhibit signal is applied by the corresponding comparator through respective ones of AND gates 94–96 and invertors 97–99 to AND gates 84–86, respectively, the application of normal stepper pulses to the corresponding one of motor phase signal circuits 88–90 is interrupted, and the corresponding reel is stopped, either abruptly by force of the motor or by a ramp-down procedure to be described. Once the reels have stopped, if the game result for the generated random number is a win, an appropriate signal indicative of the pay-out amount is generated by EPROM 79 and applied to hopper mechanism 36 to pay out the appropriate number of coins.

It will be understood that each of the reel assemblies, except for the symbol make-up of their individual reels 26–28, which may or may not be the same, may be identical in construction and operation. Similarly, each of the three motor drive circuits 91–93 may be identical in structure and operation.

To achieve the necessary free-spin periods for reels 26–28, game control circuits 77 include three delay circuits 100–102. Delay circuit 100, which is triggered by actuation of spin switch 181 through an inverter 103, may provide a delay, for example, of approximately one second. During this delay period AND gate 94 is inhibited by the delay circuit, preventing the application of a stop signal from comparator 80 to AND gate 84 through inverter 97. Delay circuit 101, which is triggered by the stop signal at the output of AND gate 94, similarly prevents the output of comparator 81 from inhibiting AND gate 85 through inverter 98 for approximately one second following the stopping of display reel 26. Delay circuit 102 in like manner prevents the output of comparator 82 from inhibiting AND gate 86 for one second following the stopping of display reel 27.

Protection against tampering or malfunction is provided by an RS flip-flop 104 which is set by the output of AND gate 96 when the third reel 28 comes to rest. The $\overline{Q}$ output of this flip-flop is applied to an AND gate 106, which inhibits the application of stepper pulses to the motor phase signal circuits. The Q output of RS flip-flop 104 is applied through an inverter 107 to a NAND gate 108, which also receives the output of a delay circuit 109 triggered by spin switch 181. In the event the reels have not comes to rest within the time period established by delay circuit 109, NAND gate 108 produces an output which is applied through NAND gate 110 to an alarm circuit 111 and through an inverter 112 to an inhibiting input of coin hopper 36.

Further protection against tampering is provided by an inverter 113 and NAND gate 114, which provide an alarm output through NAND gate 110 if the reels are moved after the reels have stopped and RS flip-flop 104 is set.

While control circuits 77 have been shown and explained in terms of certain logic components, it will be appreciated that the same functionality can be readily obtained by means of a conventional microprocessor using well known programming techniques. For example, in the present embodiment all the functions of circuits 77 can be accomplished using, for example, a type ATMEL 89C2051 microprocessor in conjunction with an appropriate EPROM and conventional and well known peripheral components. Furthermore, while a three reel machine is shown, one or more additional reels can be provided utilizing the control methods described for reels 26–28.

To provide for high odds payouts it is necessary that random number generator 78 be capable of providing random numbers within a wide range of possibilities. In particular, to provide a desirable one million dollar payout on a one dollar bet a probability of less than 0.0000001 is desirable on the winning symbol combination (777 in the present embodiment) providing that payout. Thus, the random number generated by EPROM 79 must be at least 24 bits. To provide additional precision in game play, a 28 bit random number generator is preferably used, providing a range or set of random numbers from 0 to 268,435,455.

A look-up table implementing the 28 bit random number in a representative game having the five different non-blank symbols is shown in FIGS. 10A–10E. Referring to these Figures, it is seen that 216 different combinations of the symbols on three reels, i.e., 216 different game results, are possible. Each of the different game results is given a subset within the 0–268,435,455 set of random numbers.

Certain winning combinations of symbols (such as "777") are given a low probability and a high payout. Losing combinations may be given a high probability. In the illustrated table, for example, the first 97 losing game results have the same size subset (2,416,822) and hence the same probability of occurrence (0.009003364) and same zero payout. Winning game results in the table, depending on the particular symbols being displayed, have lesser probabilities. For example, game result 143, which displays three cherries, has a subset or weight of 1,584,515 possibilities, a probability of occurrence of 0.005902778, and a payout of 12 times the bet. Game result 195, the "777" jackpot, has a subset with a weight of 19, a probability of occurrence of 0.000000071, and a payout of 1,000,000 times the bet.

As shown in FIGS. 24A–24E it is also possible to completely omit certain undesirable game results by reducing the associated subset in the EPROM to zero. For example, the 3 blanks corresponding to game result 1 in FIGS. 10A–10E may be eliminated by reducing the subset from 0 to 2,416,821, weight 2,416,822, to a subset of 0, weight 0. The weight of this combination is spread proportionately across the other 96 losing combinations.

This adds to the enjoyment of the user, since he always sees at least one symbol, albeit a losing combination. The probability of other undesirable losing results may similarly be reduced or eliminated. For example, the appearance of a blank on the first reel, or on the first and second reels, which would cause the player to give up prior to completion of play.

Thus, the look-up table embodied in EPROM 79 provides the game designer a high degree of flexibility. By varying the size of a subset of random numbers which will give a particular game result, i.e., a particular set of game symbols, the odds of occurrence of that result, and hence the payout which can be assigned to that result, can be readily set. Since these selections are contained in a replaceable EPROM, the make-up of the game can be easily changed to provide greater or lesser odds (and hence greater or lesser sized payouts), and more frequent or less frequent payouts. Furthermore, by increasing the size of subsets for game results which provide symbol combinations which constitute "near wins", i.e., one symbol of the result just one display position away from providing a winning symbol display, the designer can make the game more exciting to the player.

Further flexibility is provided to the designer by the construction of the reel assemblies. In particular, since display reels 26–28 can be readily removed from their associated motor shafts 41 without disturbing the sensor assemblies 47, an operator can change reel makeup at the same time he changes EPROM 79, allowing for a completely different game to be installed.

Figures 11, 12:
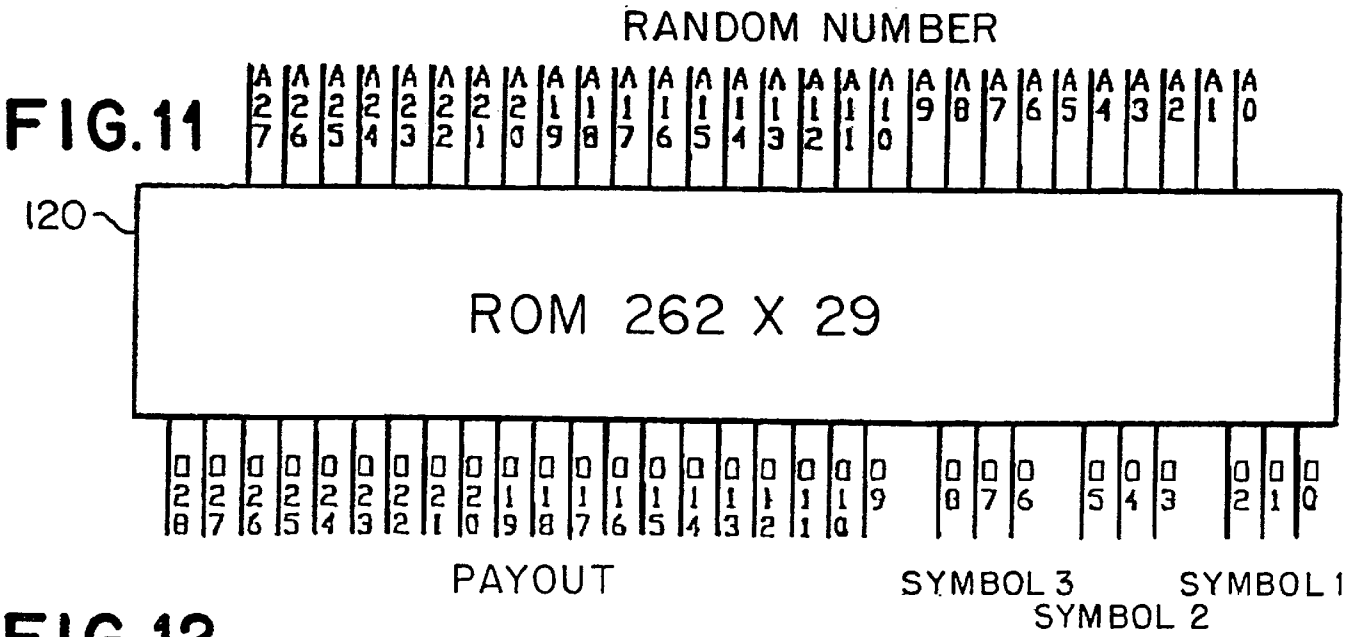
FIG. 11 illustrates an EPROM for implementing the table of FIGS. 10A–10E.
FIG. 12 illustrates the date content of the EPROM of FIG. 11.

A 262M×29 EPROM 120 suitable for use in implementing the look-up table of FIGS. 10A–10E in control circuits 77 is shown in FIGS. 11 and 12. The 28 bit random number generated by random number generator 78 is entered on pins Aϕ–A27. Symbols SYM1, SYM2 and SYM3 for reels 26–28 are derived on pins 0ϕ–02, 03–05, and 06–08, respectively. The payout (0–1,000,000), requiring 20 bits, is provided on pins 09–028.

Thus, as shown in FIG. 12, for any 28 bit input of a random number, EPROM 120 provides on its output pins three three bit binary numbers representing the three game symbols of the game result, and one 20 bit number representing the payout for that game result.

Figure 13:
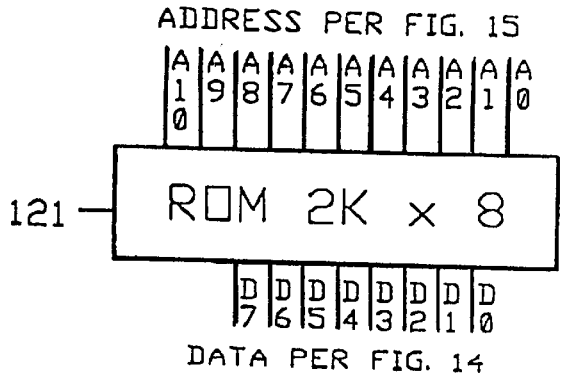
FIG. 13 illustrates an alternate form of EPROM for implementing the table of FIGS. 10A–10E.
Figure 14:
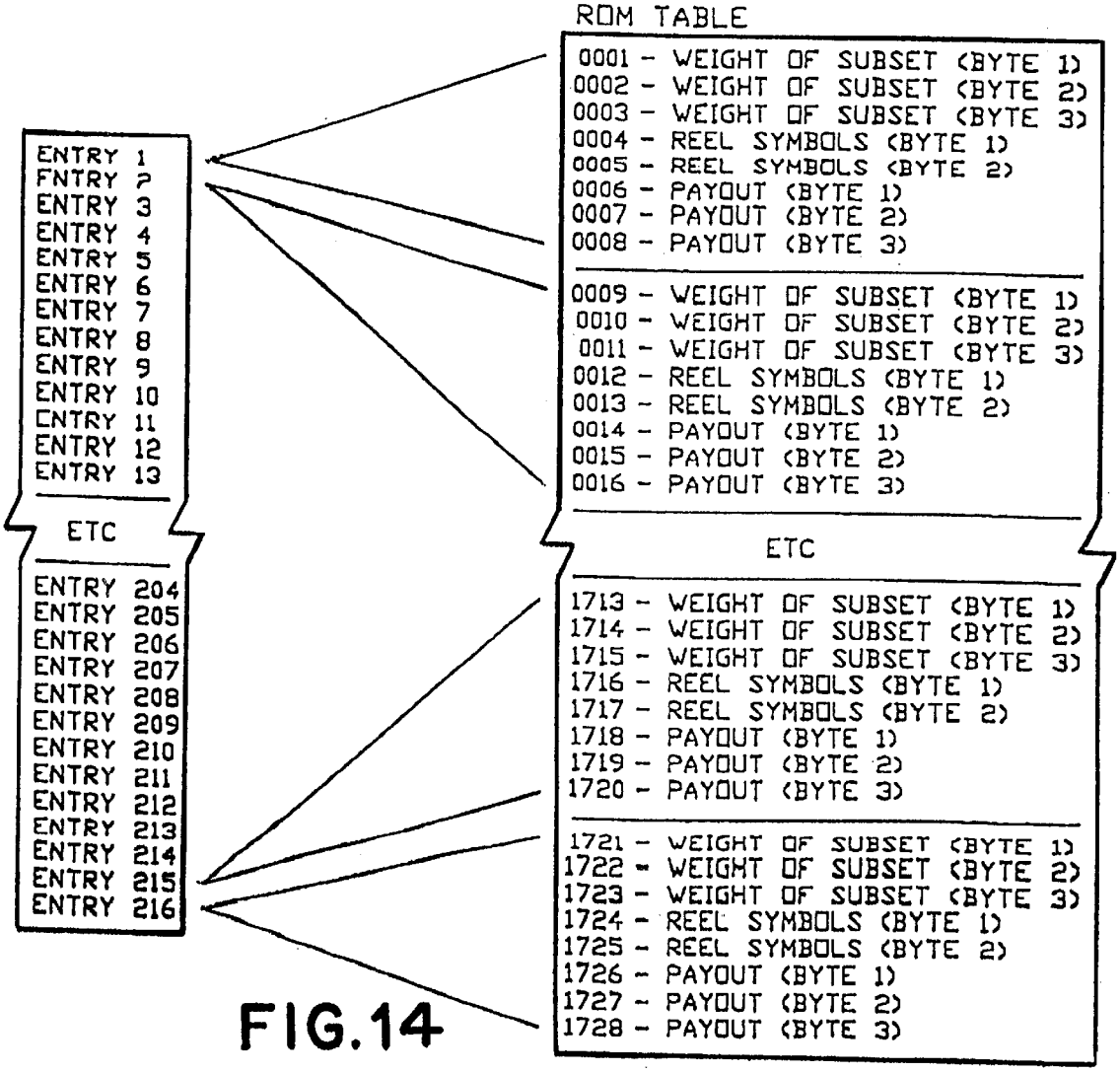
FIG. 14 illustrates the date content of the EPROM of FIG. 13.
Figure 15:
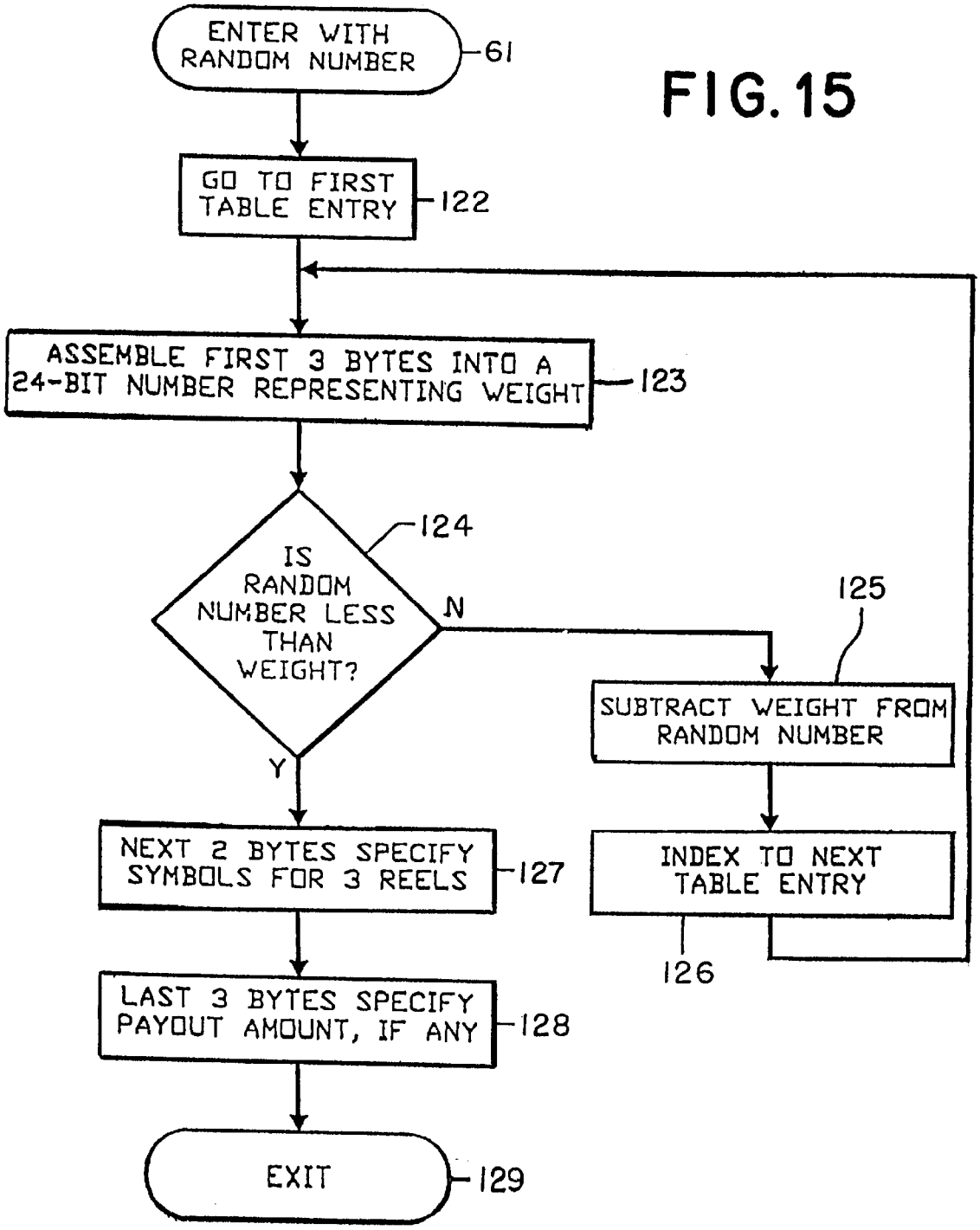
FIG. 15 is a flow chart illustrating the use of the EPROM of FIG. 13 in the slot machine of FIGS. 1 and 2.
Figure 16:
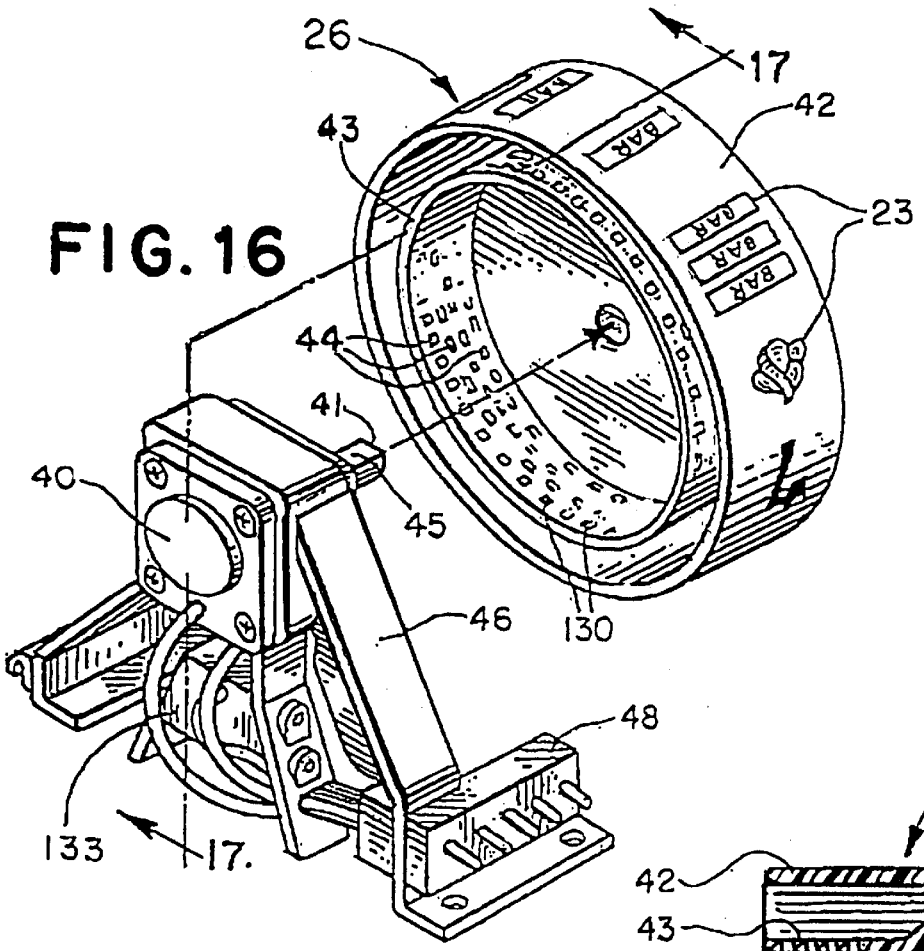
FIG. 16 is an enlarged exploded view of an alternate form of the reel assembly of FIG. 3.
Figure 17:
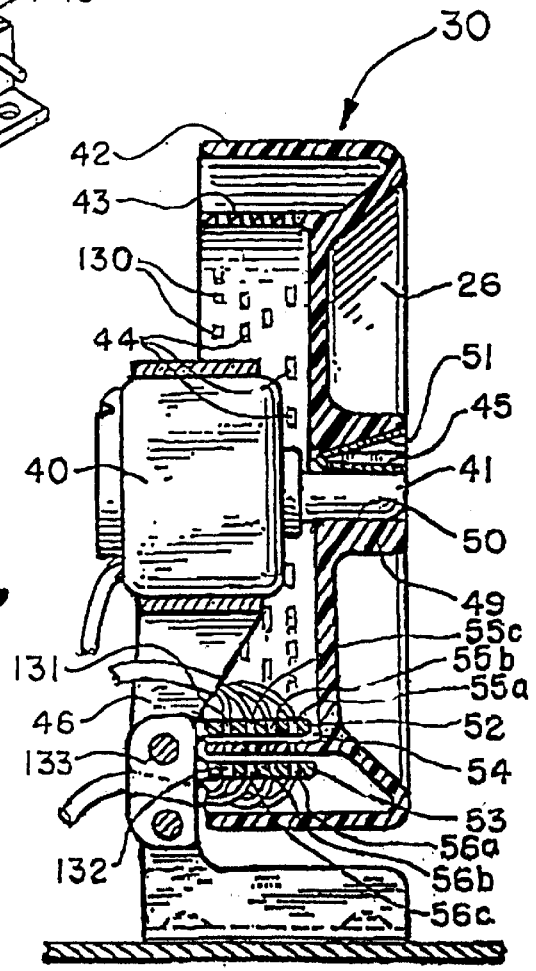
FIG. 17 is a cross-sectional view of the reel assembly of FIG. 16 taken along line 17—17 of FIG. 16.

While the 262M×29 EPROM 120 of FIG. 11 would provide satisfactory results, a more efficient implementation of the look-up table in a 2K×8 EPROM 121 is shown in FIGS. 13–15. In particular, the look-up table in the 2K×8 EPROM 121 is condensed to require only eight bytes for each of the 216 possible game results. The first three bytes (24 bits) encode the weight of the subset (the span between the "From" and "To" entries in FIGS. 10A–10E). Two bytes (16 bits) encode the game results (the three game symbols, 3 bits for each reel), and three bytes (24 bits) encode the amount of payout (up to 16,777,215 times the bet, if all 24 bits are used). Thus, each consecutive block of eight bytes in the EPROM represent a single line entry, as shown in FIG. 14. The total size of the EPROM need be only 1728×8.

The method of accessing the condensed look-up table in EPROM 121 is shown in FIG. 15. First, a 28 bit random number is generated at 61 as previously described. Then, at 122 the first EPROM address is accessed. At 123 the first three bytes beginning at that address are assembled into a 24 bit number representing the size or weight of the subset represented by the address. If the random number is greater than the accessed subset weight at 124, then at 125 the subset weight is subtracted from the random number and the next table entry is accessed at 126. The weight of the subset represented by this address is obtained by combining the first 3 bytes beginning at that address into a 24 bit number. This number is compared with the previously modified random number at 124. If the modified random number is greater, then the weight is again subtracted and the look-up procedure is repeated.

If the random number is less than the subset weight derived from the table, the next two bytes of the accessed data are utilized at 127 to specify the game result, i.e., the game symbols to be displayed by the three display reels (3 sets of 3 bits each). The last three bytes (24 bits) are combined at 128 to specify the payout amount, if any. The game results and payout being specified, the routine ends at 129 and the reels are repositioned to display the game results, as previously described. Thus, the procedure outlined in FIG. 15 enables a much smaller and less expensive EPROM to be used in slot machine 20.

As previously mentioned, where a smaller stepper motor is utilized which provides a larger number of steps per revolution, 200 or 400 stops for example, it may be preferable to incorporate ramp-up and ramp-down routines in the starting and stopping of the display reels to prevent the stepper motors from slipping, i.e., failing to step in response to a stepper pulse. With such routines, lower rate stepping pulses are applied to the stepper motor drive circuits 91–93 for a ramp-up period following a spin command (as when spin button 181 is actuated) and for a ramp-down period following a stop command (as when a comparator generates a stop signal).

Referring to FIGS. 16–20, an advantageous construction for obtaining a stop initiating command is to provide an additional set of binary coded indicia 130 (FIG. 18) angularly displaced from the symbol-indicating stop indicia associated with the displayed game symbol. This additional stop initiating indicia, which preferably utilizes the same 3 bit binary coding as the stop command indicia, is differentiated from the stop indicia by the presence of a fourth bit, contained in a fourth column D in FIG. 18. The fourth bit may be represented by an aperture which is shorter than the apertures representing the other three bits so as to act as a strobe bit for greater precision in detecting the passage of the symbol code. An additional LED light source 131 and associated photosensor 132 are provided in a sensor assembly 133 (FIG. 17) mounted on the reel assembly frame to detect the additional bit.

Figure 18:
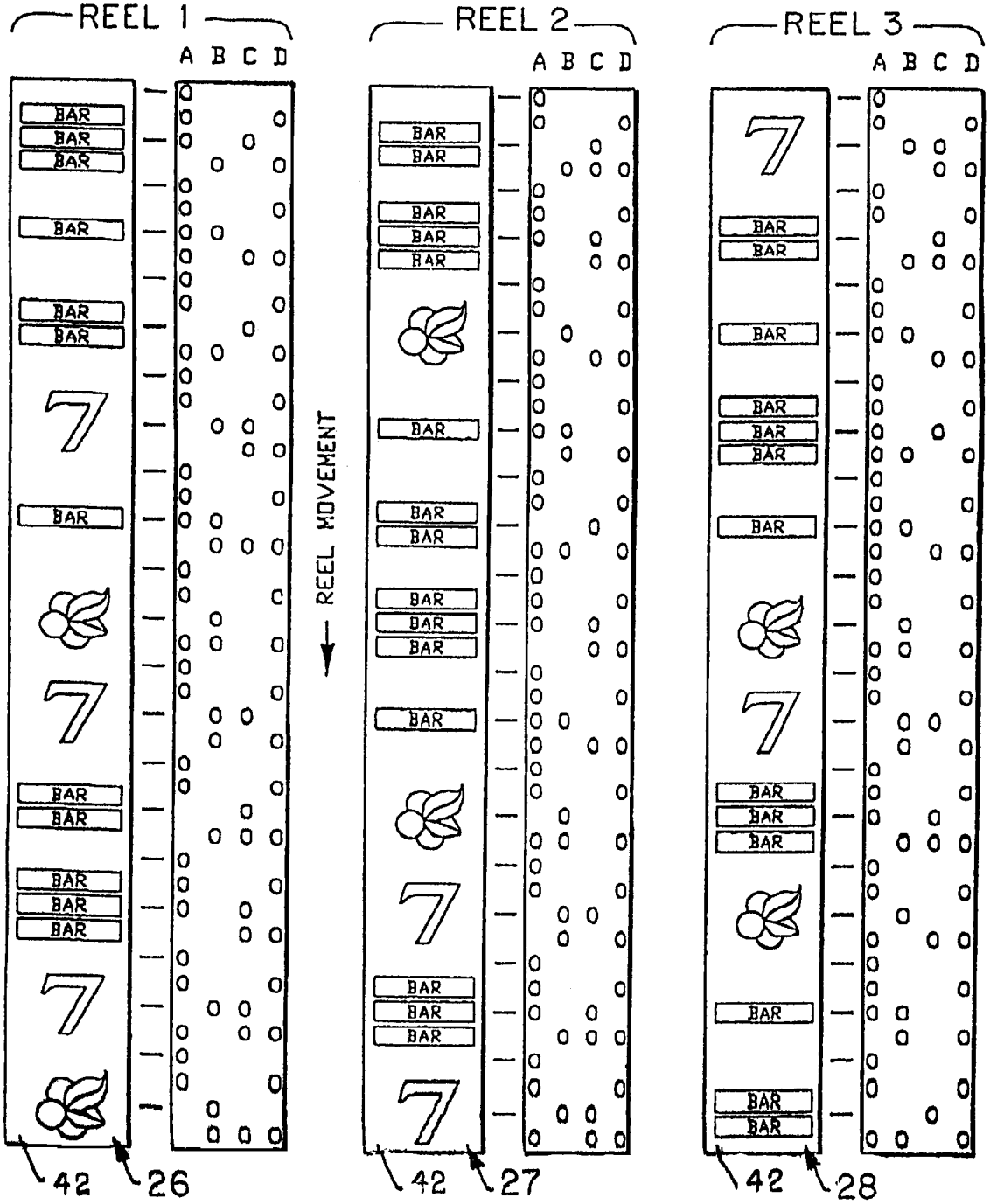
FIG. 18 is an illustration of a representative arrangement of game symbols and game symbol-indicating indicia on the alternate form of reel assembly of FIGS. 16 and 17.

As shown for the three display reels 26–28 in FIG. 18, the stop initiating indicia are spaced ahead of the stop-indicating indicia by an angular displacement sufficient to allow the display reel to be ramped down to a slow stopping speed prior to the reel reaching the stop position. When the reel reaches the stop position, as signaled by the stop-indicating indicia, the application of the slow stepping pulses is interrupted and the reel abruptly stops.

In practice, for a 200 step motor operating at 2 revolutions per second, 45 stepping pulses may be utilized in slowing the motor to a desirably slow stopping speed. This results in the stop-initiating indicia being located approximately two and one-half symbol display positions ahead of the stop-indicating indicia, as shown in FIG. 18.

Figure 19:
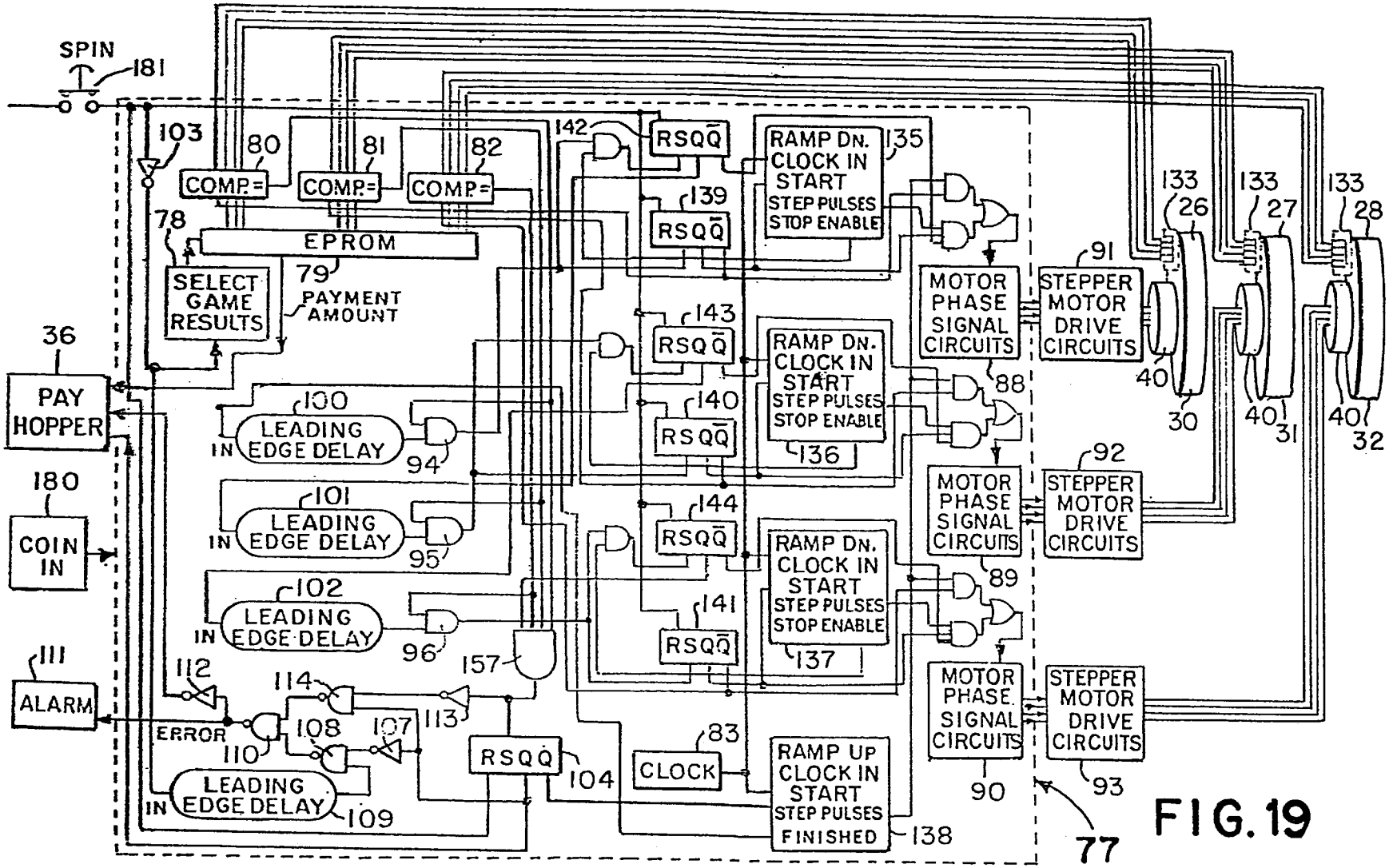
FIG. 19 is a simplified schematic partially in functional block form illustrating the operation of a slot machine utilizing the alternate reel assembly of FIGS. 16–18.
Figure 20:
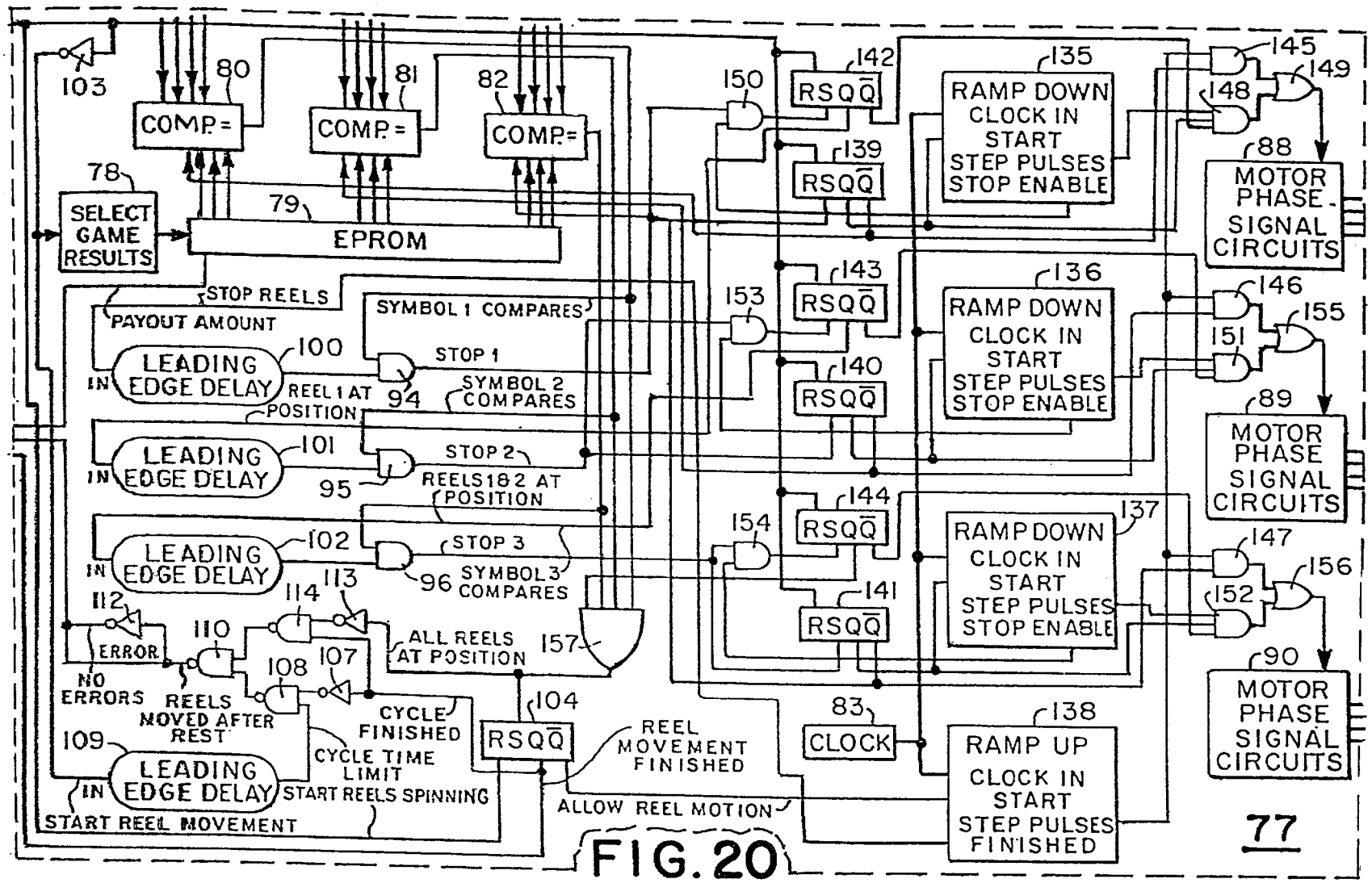
FIG. 20 is a simplified schematic diagram of a portion of the functional block diagram of FIG. 19.

Referring to FIGS. 19 and 20, three ramp-down circuits 135–137 provide decreasing rate stepping pulses to stepper motor drive circuits 91–93 during the stopping routine, and a single ramp-up circuit 138 provides increasing rate stepper pulses during the starting routine. The operation of the ramp-down circuits is controlled by three RS flip-flops 139–141, which initiate the ramp-down routine, and three RS flip-flops 142–144, which stop the reels. The operation of ramp-up circuit 138 is controlled by spin switch 181.

Upon actuation of spin switch 181, all six RS flip-flops 139–144 are reset. The $\overline{Q}$ outputs of flip-flops 139–141 enable three AND gates 145–147, which allow stepper pulses developed by ramp-up circuit 138 to be applied to the three stepper motor phase signal circuits 88–90. At the same time, the $\overline{Q}$ output of RS flip-flop 104, which is reset by spin switch 181, causes ramp-up circuit 138 to initiate the ramp-up routine.

When the ramp-up routine is complete, circuit 138 provides an output to delay circuit 100, which times the free-spin period of reel 26 as previously described. After this free-spin period, AND gate 94 is enabled to allow the output of comparator 80 to initiate a stop routine. As before, comparator 80 is looking for a match with the symbol indicia provided by EPROM 79. However, the $\overline{Q}$ output of RS flip-flop 139, in its reset state, requires that the fourth bit associated with stop-initiating indicia also be present for a match. This prevents the comparator from responding to stop-indicating symbol indicia passing detector 133, and allows the comparator to respond to stop-initiating indicia on reel 26.

When a match is recognized by comparator 80, RS flip-flop 139 is set, and AND gate 145 is inhibited to prevent stepper pulses from the ramp-up circuit 138 from being applied to motor phase signal circuits 88. At the same time, the Q output of RS flip-flop 139 enables an AND gate 148, allowing pulses from ramp-down circuit 135 to be applied to stepper motor drive circuits 91 through an OR gate 149. Since the $\overline{Q}$ output of flip-flop 139 no longer requires comparator 80 to sense the fourth bit, the comparator responds to the next-occurring stop-indicating symbol indicia to provide a signal which is applied through an AND gate 150, upon receipt of a stop enabling signal from ramp-down circuit 135, to set RS flip-flop 142, which inhibits AND gate 148 to prevent further application of pulses to stepper motor drive circuits 91. Lack of the stop enabling signal from ramp-down circuit 135 prevents RS flip-flop 142 from being set by the comparison output which occurs with passage of the stop-initiating symbol indicia or with passage of any stop-indicating symbol indicia prior to the completion of a substantial portion of the ramp-down. Delay circuit 101 is actuated when RS flip-flop 142 is set to initiate the free spin period for display reel 27.

Display reels 27 and 28 are controlled in a similar manner by RS flip-flops 140 and 141, which initiate the ramp-down routine, and RS flip-flops 143 and 144, which stop the reels in conjunction with AND gates 151–154 and OR gates 155 and 156 (FIG. 20).

The function of RS flip-flop 104 is as previously described, except that the device is set by the output of an AND gate 157, which provides a set signal when all three comparators 80–82 indicate a match (i.e., when all three display reels are displaying the game result symbols called for by EPROM 79) and RS flip-flop 144 is set, indicating that the third reel has stopped. When these conditions are fulfilled, RS flip-flop 104 is set and NAND gate 114 is enabled, so that any subsequent change in state of AND gate 157, as by movement of a reel, causes activation of alarm 111.

Figure 21:
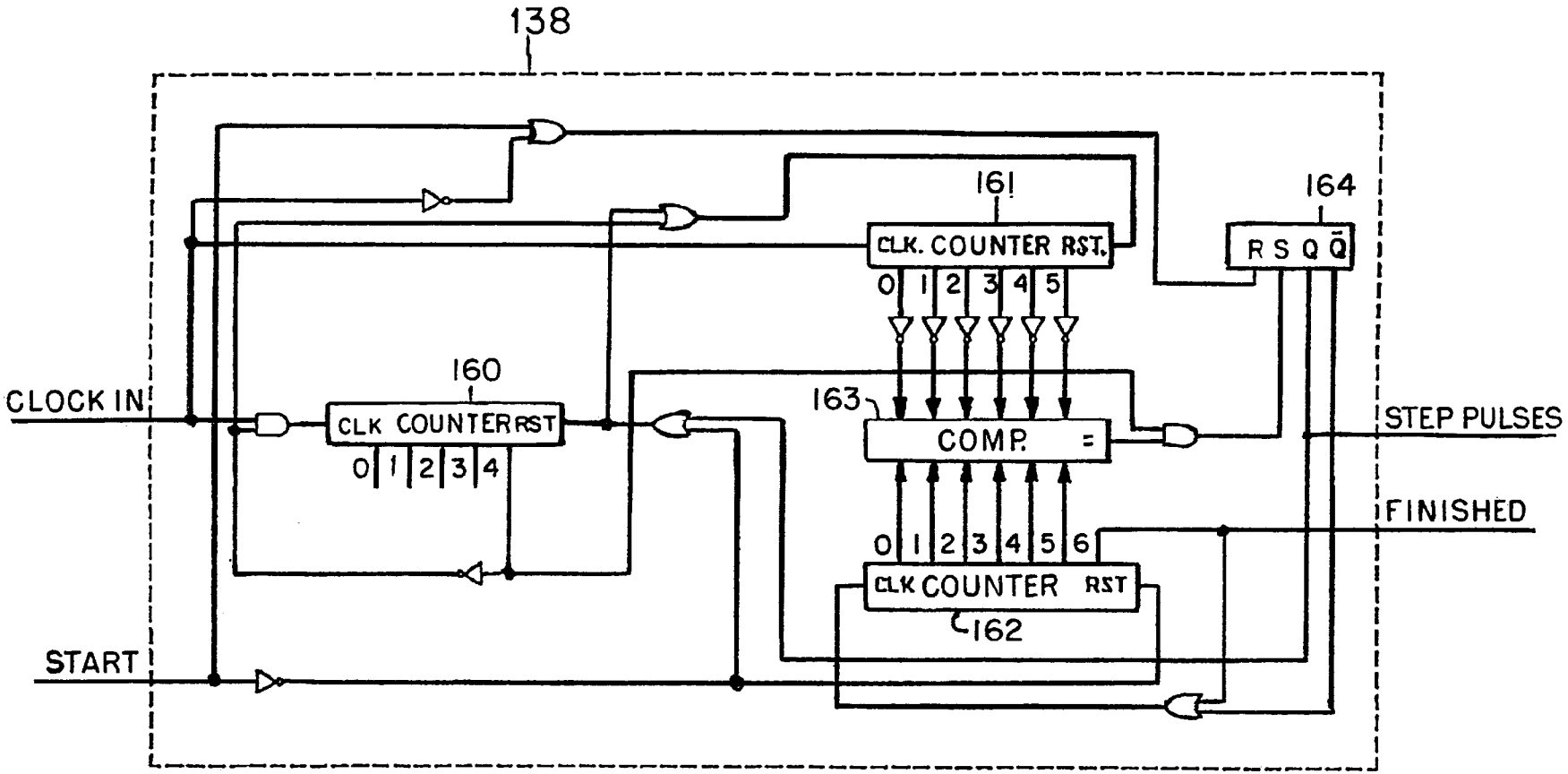
FIG. 21 is a simplified schematic diagram of the ramp-up circuit utilized in the slot machine of FIG. 19.

Referring to FIG. 21, one form of ramp-up circuit 138 suitable for use in slot machine 20 is seen to include three counters 160–162, a comparator 163, and an RS flip-flop 164. While the start signal is false, all three counters are held in reset and RS flip-flop 164 is reset. Upon actuation of spin switch 181, the start signal is true and counter 160 counts applied clock pulses until a count of 16 is reached, at which time the counter produces an output which inhibits further counting by the counter and enables counter 161 to count clock pulses. Counter 161 continues to count from zero until its output, applied inverted to comparator 163, compares to the initial zero count in counter 162. Initially, this does not occur until counter 161 has counted to its capacity count of 63, producing all logic 1's which when inverted match the all logic 0's of counter 162.

When a match is recognized by comparator 163, an output of the comparator sets RS flip-flop 164, producing at the Q output of that device a stepping pulse for application to the stepper motor phase circuits, and at the $\overline{Q}$ output a signal which increments counter 162 one count.

The Q output of RS flip-flop 164 also resets counters 160 and 161, allowing counter 160 to again count clock pulses. With the next negative transition of the clock pulse, RS flip-flop 164 is reset and counter 162 is advanced one count. When counter 160 again reaches its maximum count of 16, counter 161 is again enabled and begins counting clock pulses. Since there is now a one count in counter 162, counter 161 needs only to count to 62 before its inverted output compares with the non-inverted output of counter 162 and comparator 163 produces an output which resets RS flip-flop 164. As before, this produces a stepping pulse for application to the stepper motor phase circuits, an increment of one count in counter 162, and a reset of counters 160 and 161.

In this manner, stepping pulses are produced with linearly increasing frequency as counter 161 counts to progressively lower counting states to match the progressively increasing counting state of counter 162. In practice, the ramp-up circuit may initially produce stepping pulses at 160 hertz, ramping-up in 64 linear steps to a pulse rate of 800 hertz, which it continues to produce until a subsequent start signal is received. With a nominal clock frequency of 12.8 KHz, this results in a ramp-up speed starting at 0.4 RPS and increasing to 2.0 RPS.

The functioning of ramp-down circuit 135 is similar to ramp-up circuit 138 except that the outputs of counter 161 are applied to comparator 163 non-inverted.

Figure 22:
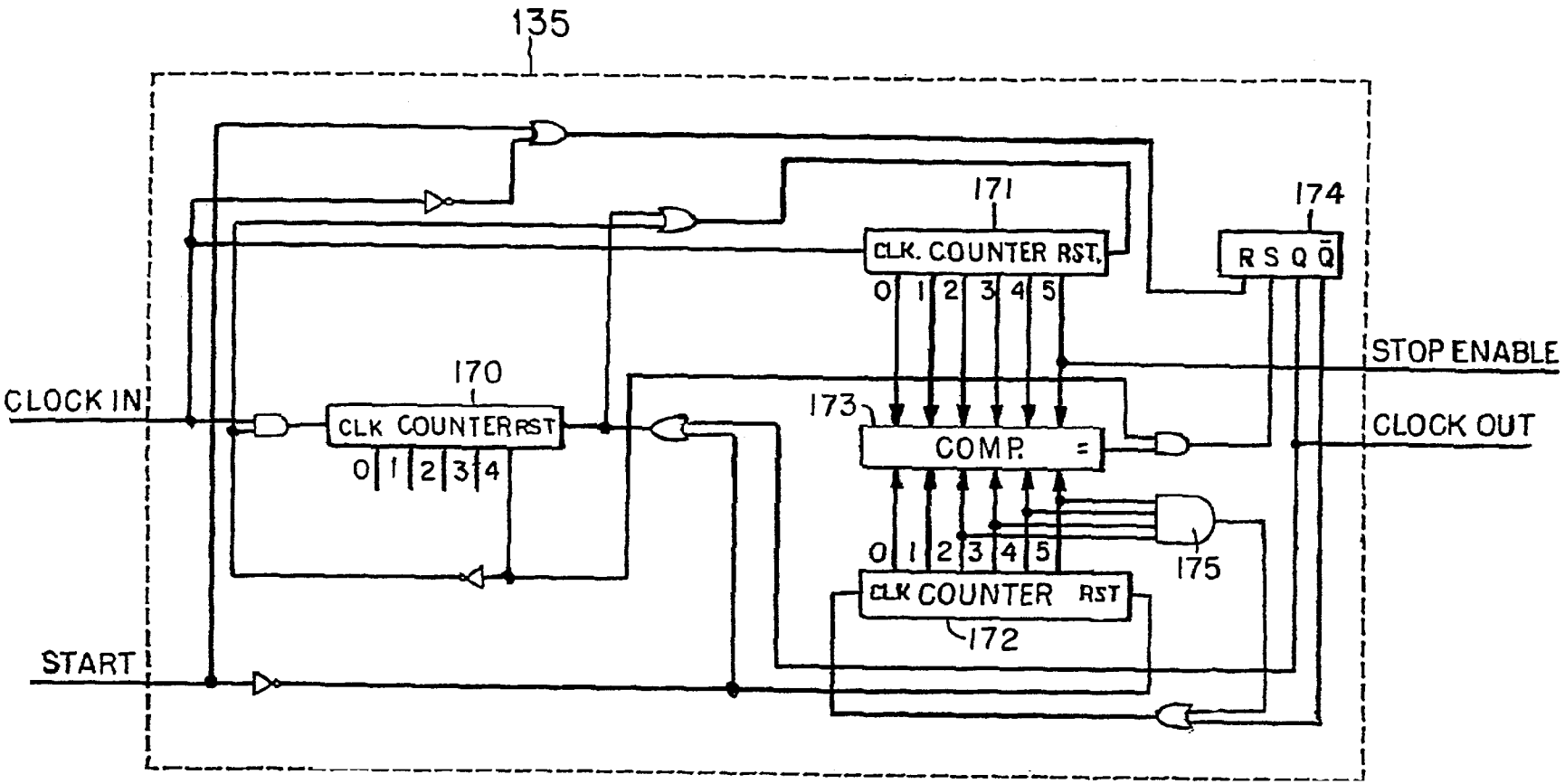
FIG. 22 is a simplified schematic diagram of the ramp down-circuit utilized in the slot machine of FIG. 19.

Referring to FIG. 22, one form of ramp-down circuit 135 suited for use in slot machine 20 is seen to include three counters 170–172, a comparator 173 and an RS flip-flop 174. While the start signal is false, all three counters are held in reset and RS flip-flop 174 is reset. Upon actuation of spin switch 181, the start signal is true and counter 170 counts applied clock pulses until a count of 16 is reached, at which time the counter produces an output which inhibits further counting by the counter and enables counter 171 to count clock pulses. Counter 161 continues to count from zero until its output, applied to comparator 173, compares to the initial zero count in counter 172. Initially, this occurs immediately, causing the comparator to produce an output which sets RS flip-flop 174, producing at the Q output of that device a stepping pulse for application to the stepper motor phase circuits, and at the $\overline{Q}$ output a signal which increments counter 172 one count.

The Q output of RS flip-flop 174 also resets counters 170 and 171, allowing counter 170 to again count clock pulses. With the next negative transition of the clock pulse, RS flip-flop 174 is reset and counter 172 is advanced one count. When counter 170 again reaches its maximum count of 16, counter 171 is again enabled and begins counting clock pulses. Since there is now a one count in counter 172, counter 171 needs to count to 1 before its output compares with the output of counter 172 and comparator 173 produces an output which resets RS flip-flop 164. As before, this produces a stepping pulse for application to the motor phase circuits, an increment of one count in counter 172, and a reset of counters 170 and 171. This cycle continues until counter 172 reaches its maximum counting state of 43, as determined by an AND gate 175, at which time counter 172 is no longer incremented and RS flip-flop 174 is regularly toggled at a fixed slow rate as counter 171 repeatedly counts to 63.

In this manner, stepping pulses are produced with linearly decreasing frequency as counter 171 is required to count to progressively higher counting states to match the progressively increasing counting state of counter 172. In practice, the ramp-down circuit may initially produce stepping pulses at 800 hertz, and ramp-down in 45 linear steps to a pulse rate of 210 hertz, at which rate it continues to produce pulses until a stop signal is received. With a nominal clock frequency of 12.8 KHz, this results in a ramp-down speed starting at 2 RPS and ending at 0.4 RPS.

While the ramp-up and ramp-down functions of this alternate embodiment of the invention have been illustrated using discrete logic components, it will be appreciated that all of the same functions and results can be advantageously performed by a conventional microprocessor using well known conventional programming techniques.

A slot machine has been shown and described wherein a random number generator generates a random number, an EPROM assigns a game result consisting of a non-blank or blank game symbol for each reel, and the reels spin and are stopped to display the game result when the associated game symbol passes a sensor. By changing the EPROM, the probability of a particular game result occurring can be quickly and easily changed by a technician.

While particular embodiments of the invention have been shown and described, it will be obvious to those skilled in the art that changes and modifications may be made therein without departing from the invention in its broader aspects, and, therefore, the aim in the appended claims is to cover all such changes and modifications as fall within the true spirit and scope of the invention.

We claim:

1. A reel-type slot machine comprising:

a user actuated spin switch for providing a play command;

at least one display reel having a plurality of different game symbols thereon, said display reel being rotatably mounted to selectively display one of said game symbols;

reel drive means responsive to said play command for rotatably driving said display reel;

selection means responsive to said play command for randomly generating a random number from a predetermined set of random numbers;

memory means for providing a game result from a predetermined set of potential game results for each random number in said set of random numbers, each of said game results requiring display of an associated predetermined game symbol by said display reel, said memory means providing a display control signal indicative of said predetermined game symbol; and display control means responsive to said display control signal for causing said reel drive means to position said display reel to display said predetermined game symbol wherein said predetermined set of potential game results includes an undesired, and wherein said memory means stores a zero probability at a random number for said undesired game result.

2. A reel-type slot machine as defined in claim 1 wherein said display reel has a predetermined number of different game symbols which is less than the number of random numbers within said predetermined set of random numbers.

3. A reel-type slot machine as defined in claim 2 wherein said display reel contains at least two of each of said different game symbols.

4. A reel-type slot machine as defined in claim 1 wherein said display reel includes indicia fixedly positioned on said reel for identifying each of said game symbols thereon, and said display control means is further responsive to said indicia.

5. A reel-type slot machine as defined in claim 4 further including indicia detection means fixedly positioned relative to said display reel for providing a tracking signal indicative of the passage of each of said game symbols as said reel turns, said display control means being responsive to said tracking signal and said display control signal for stopping said display reel to display said predetermined game symbol.

6. A reel-type slot machine as defined in claims 4 or 5 wherein said display reel has at least five different symbols and said indicia comprises at least three binary digits.

7. A reel-type slot machine as defined in claim 1 wherein said reel drive means comprise a stepper motor.

8. A reel-type slot machine as defined in claim 7 wherein said reel drive means is responsive to applied stepping pulses, and said display control means interrupt said stepping pulses to stop said display reel.

9. A slot machine as defined in claim 1 wherein said selection means comprise a random number generator and said memory means comprise a look-up table responsive to said random number.

10. A slot machine as defined in claim 9 wherein said memory device comprises an electronically programmable read only memory (EPROM).

11. A reel type slot machine as defined in claim 1 wherein each of said different game results is associated with a predetermined subset of random numbers within said predetermined set of random numbers, the size of said subset determining the probability of said game result occurring.

12. A reel type slot machine as defined in claim 11 wherein said set of potential game results includes an undesired game result, and the size of the subset for said undesired game result is zero.

13. A reel type slot machine as defined in claim 1 wherein said machine has multiple display reels each having a plurality of different game symbols thereon, said memory means provide a display signal indicative of a game symbol for display by each of said display reels, and said display control means cause said reel drive means to position each of said display reels to display its respective game symbol.

14. A reel-type slot machine comprising:

a user actuated spin switch for providing a play command;

a plurality of display reels each having a plurality of different game symbols thereon, said display reels each being rotatably mounted to each selectively display one of said game symbols;

reel drive means responsive to said play command for rotatably driving said display reels;

selection means responsive to said play command for randomly generating a random number from a predetermined set of random numbers;

memory means for providing a game result from a predetermined set of potential game results for each random number in said set of random numbers, said game result requiring display of a predetermined game symbol on each of said display reels, said memory means providing a display control signal for each display reel indicative of said predetermined game symbol to be displayed by that reel; and display control means responsive to said display control signals for causing said reel drive means to position said display reels to display said predetermined game symbols wherein said predetermined set of potential game results includes an undesired, and wherein said memory means stores a zero probability at a random number for said undesired game result.

15. A reel-type slot machine as defined in claim 14 wherein the number of potential combinations of game symbols on said display reels is less than the number of random numbers within said predetermined set of random numbers.

16. A reel-type slot machine as defined in claim 14 wherein each of said display reels contains at least two of each of said different game symbols.

17. A reel-type slot machine as defined in claim 14 wherein each of said display reels includes indicia fixedly positioned on said reel for identifying each of said game symbols thereon, and said display control means is further responsive to said indicia.

18. A reel type slot machine as defined in claim 17 further including indicia detection means fixedly positioned relative to each of said display reels for providing a tracking signal indicative of the passage of each of said game symbols as said reels turn, said display control means being response to said tracking signal and said display control signal for stopping aid display reels to display said predetermined game symbols.

19. A reel-type slot machine as defined in claim 17 or 18 wherein said display reel has at least five different symbols and said indicia comprises at least three binary digits.

20. A reel-type slot machine as defined in claim 14 wherein said reel drive means comprise stepper motors associated with respective ones of said reels.

21. A reel-type slot machine as defined in claim 20 wherein said reel drive means are responsive to applied stepping pulses, and said display control means interrupt said stepping pulses to stop said display reels.

22. A slot machine as defined in claim 14 wherein said selection means comprise a random number generator and said memory means comprise a look-up table responsive to said random number.

23. A slot machine as defined in claim 22 wherein said memory device comprises an electronically programmable read only memory (EPROM).

24. A reel type slot machine as defined in claim 14 wherein each of said different game results is associated with a predetermined subset of random numbers within said predetermined set of random numbers, the size of said subset determining the probability of said game result occurring.

25. A reel type slot machine as defined in claim 24 wherein said set of potential game results includes an undesired game result, and the size of the subset for said undesired game result is zero.

26. A reel-type slot machine comprising:

a user actuated spin switch for providing a play command;

at least one display reel having a plurality of different game symbols thereon, said display reel being rotatably mounted to selectively display one of said game symbols, and including indicia thereon indicative of each game symbol thereon;

reel drive means responsive to said play command for rotatably driving said display reel;

a random number generator responsive to said play command for randomly generating one random number from a predetermined set of random numbers;

a memory device comprising a look-up table responsive to said random number for generating a display control signal indicative of a predetermined game symbol corresponding to said selected random number to provide a game result from a predetermined set of potential game results for each random number in said set of random numbers; and indicia detection means fixedly positioned relative to said display reel for providing a tracking signal indicative of the passage of each of said game signals during rotation of the reel;

display control means responsive to said display control signal and said tracking signal for causing said reel drive means to position said display reel to display said predetermined game symbol wherein at least one undesirable game result is eliminated from said predetermined set of potential game results by having a probability of the at least one undesirable game result set to zero.

27. A reel-type slot machine as defined in claim 26 wherein said display reel has a predetermined number of different game symbols which is less than the number of random numbers within said predetermined set of random numbers.

28. A reel-type slot machine as defined in claim 26 wherein said display reel contains at least two of each of said different game symbols.

29. A reel-type slot machine as defined in claim 26 wherein said display reel has at least five different symbols and said indicia comprises at least three binary digits.

30. A reel-type slot machine as defined in claim 26 wherein said reel drive means comprise a stepper motor.

31. A reel-type slot machine as defined in claim 30 wherein said reel drive means is responsive to applied stepping pulses, and said display control means interrupt said stepper pulses to position said display reel.

32. A slot machine as defined in claim 26 wherein said memory device comprises an electronically programmable read only memory (EPROM).

33. A reel type slot machine as defined in claim 26 wherein each of said different game results is associated with a predetermined subset of random numbers within said predetermined set of random numbers, the size of said subset determining the probability of respective ones of said game results being displayed.

34. A reel type slot machine as defined in claim 26 wherein said machine has multiple display reels each having a plurality of different game symbols thereon, said memory device generates a display control signal for each of said display reels indicative of a respective predetermined game symbol for display by each of said display reels, and said display control means position each of said display reels to display its predetermined associated game.

35. A reel-type slot machine comprising:

a user actuated spin switch for providing a play command;

a plurality of display reels each having a plurality of different game symbols thereon, said display reels each being rotatably mounted to selectively display one of said game symbols and including indicia thereon indicative of each game symbol thereon;

reel drive means responsive to an applied control effect for rotatably driving said display reels;

a random number generator responsive to said play command for randomly generating one random number from a predetermined set of random numbers;

a memory device comprising a look-up table responsive to said random number for generating a display control signals indicative of predetermined game symbols for display respectively by each of said reels to provide a game result from a predetermined set of potential game results for each random number in said set of random numbers;

indicia detection means fixedly positioned relative to said display reels for detecting the passage of said indicia as said display reels rotate to produce respective symbol-indicating tracking signals; and display control means responsive to said display signals and said tracking signals for stopping said reels to display said predetermined game symbols wherein at least one undesirable game result is eliminated from said predetermined set of potential game results by having a probability of the at least one undesirable game result set to zero.

36. A reel-type slot machine as defined in claim 35 wherein said indicia comprise a binary code.

37. A reel-type slot machine as defined in claim 36 wherein said indicia comprise apertures in said display reel.

38. A reel-type slot machine as defined in claim 35 wherein said display reel includes a first annular portion containing said game symbols, and a second annular portion containing said indicia.

39. A reel-type slot machine as defined in claim 38 wherein said first annular portion is of greater diameter than said first portion, and said portions are coaxial.

40. A reel-type slot machine as defined in claim 39 wherein said detector means sense the passage of said indicia on said second annular portion of said reel.

41. A reel-type slot machine as defined in claim 40 wherein said indicia comprise a binary code.

42. A reel-type slot machine as defined in claim 41 wherein said indicia comprise apertures in said display reel.

43. A reel-type slot machine comprising:

a user actuated spin switch for providing a play command;

at least one display reel having a plurality of different game symbols thereon, said display reel being rotatably mounted to selectively display one of said game symbols;

reel drive means responsive to said play command for rotatably driving said display reel;

selection means responsive to said play command for randomly generating a random number from a predetermined set of random numbers;

means for assigning a game symbol to each random number within said set of random numbers;

memory means providing a game result from a predetermined set of potential game results for each random number in said set of random numbers;

said display reel including first and second sets of indicia associated with and indicative of each of said game symbols, said first and second sets of indicia being angularly displaced from each other;

detector means for detecting the passage of said indicia as said display reel rotates to produce a symbol-indicating tracking signal; and display control means responsive to said signal indicating said first set of indicia for slowing the rotation of said reel, and responsive to said output signal indicating said second set of indicia for stopping said reel wherein selection of at least one undesirable potential game result is eliminated from a predetermined set of potential game results by having a probability of each undesirable game result set to zero.

44. A reel-type slot machine as defined in claim 43 wherein said indicia comprise a binary code.

45. A reel-type slot machine as defined in claim 44 wherein said indicia comprise apertures in said display reel.

46. A reel-type slot machine as defined in claim 43 wherein said display reel includes a first annular portion containing said game symbols, and a second annular portion containing said indicia.

47. A reel-type slot machine as defined in claim 46 wherein said first annular portion is of greater diameter than said first annular portion, and said portions are coaxial.

48. A reel-type slot machine as defined in claim 47 wherein said detector means sense the passage of said indicia on said second annular portion of said reel.

49. A reel-type slot machine as defined in claim 48 wherein said indicia comprise a binary code.

50. A reel-type slot machine as defined in claim 49 wherein said indicia comprise apertures in said display reel.

* * * * *